US011459632B2

(12) United States Patent
Kubota et al.

(10) Patent No.: US 11,459,632 B2
(45) **Date of Patent: *Oct. 4, 2022**

(54) NON-ORIENTED ELECTRICAL STEEL SHEET AND METHOD FOR MANUFACTURING NON-ORIENTED ELECTRICAL STEEL SHEET

(71) Applicant: NIPPON STEEL CORPORATION, Tokyo (JP)

(72) Inventors: Takeshi Kubota, Tokyo (JP); Takeaki Wakisaka, Tokyo (JP); Takashi Morohoshi, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 69 days.

This patent is subject to a terminal disclaimer.

(21) Appl. No.: 16/771,533

(22) PCT Filed: Feb. 15, 2019

(86) PCT No.: PCT/JP2019/005606

§ 371 (c)(1),
(2) Date: Jun. 10, 2020

(87) PCT Pub. No.: WO2019/160092

PCT Pub. Date: Aug. 22, 2019

(65) Prior Publication Data

US 2021/0172036 A1 Jun. 10, 2021

(30) Foreign Application Priority Data

Feb. 16, 2018 (JP) ..... JP2018-026109

(51) Int. Cl.

| | |
|---|---|
| ***C21D 9/46*** | (2006.01) |
| ***C21D 6/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***H01F 1/147*** | (2006.01) |

(52) U.S. Cl.

CPC ..... *C21D 9/46* (2013.01); *C21D 6/005* (2013.01); *C21D 6/008* (2013.01); *C21D 8/1222* (2013.01); *C21D 8/1233* (2013.01); *C21D 8/1272* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/16* (2013.01); *H01F 1/147* (2013.01); *C22C 2202/02* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 2005/0025674 | A1 | 2/2005 | Romanauskas et al. | |
| 2009/0250145 | A1 | 10/2009 | Kurosaki et al. | |
| 2017/0194082 | A1 | 7/2017 | Murakami et al. | |
| 2018/0002776 | A1 | 1/2018 | Kano et al. | |
| 2018/0119258 | A1 | 5/2018 | Fujikura et al. | |
| 2019/0017138 | A1 | 1/2019 | Uesaka et al. | |
| 2020/0152363 | A1 | 5/2020 | Kubota et al. | |
| 2020/0350104 | A1* | 11/2020 | Kubota | C22C 38/06 |
| 2021/0062286 | A1* | 3/2021 | Kubota | C22C 38/04 |

FOREIGN PATENT DOCUMENTS

| | | | |
|---|---|---|---|
| CA | 3 005 579 | A1 | 5/2017 |
| CN | 106661686 | A | 5/2017 |
| CN | 107208220 | A | 9/2017 |
| EP | 3 243 921 | A1 | 11/2017 |
| JP | 2-133523 | A | 5/1990 |
| JP | 5-140648 | A | 6/1993 |
| JP | 6-57332 | A | 3/1994 |
| JP | 10-183309 | A | 7/1998 |
| JP | 2002-241905 | A | 8/2002 |
| JP | 2004-197217 | A | 7/2004 |
| JP | 2004-332042 | A | 11/2004 |
| JP | 2005-67737 | A | 3/2005 |
| JP | 2005-298876 | A | 10/2005 |
| JP | 2010-1557 | A | 1/2010 |
| JP | 2011-140683 | A | 7/2011 |
| TW | 201700750 | A | 1/2017 |
| TW | 201726939 | A | 8/2017 |
| WO | WO 2008/050597 | A1 | 5/2008 |
| WO | WO 2018/220837 | A1 | 12/2018 |

OTHER PUBLICATIONS

Hashimoto et al., "Effect of Rolling Condition on r-value of Extra-low-carbon Cold Rolled Steel Sheet", Iron & Steel, 1990, vol. 76, No. 1, pp. 50-56.

(Continued)

*Primary Examiner* — Jophy S. Koshy

(74) *Attorney, Agent, or Firm* — Birch, Stewart, Kolasch & Birch, LLP

(57) ABSTRACT

A non-oriented electrical steel sheet according to one embodiment of the invention has a chemical composition represented by C: 0.0030% or less, Si: 2.00% or less, Al: 1.00% or less, Mn: 0.10% to 2.00%, S: 0.0030% or less, one or more selected from the group consisting of Mg, Ca, Sr, Ba, Nd, Pr, La, Ce, Zn, and Cd: 0.0015% to 0.0100% in total, a parameter Q represented by Q=[Si]+2×[Al]−[Mn]: 2.00 or less; Sn: 0.00% to 0.40%, Cu: 0.00% to 1.00%, and a remainder: Fe and impurities, and a parameter R represented by $R=(I_{100}+I_{310}+I_{411}+I_{521})/(I_{111}+I_{211}+I_{332}+I_{221})$ is 0.80 or greater.

14 Claims, No Drawings

(56) References Cited

OTHER PUBLICATIONS

International Search Report for PCT/JP2019/005606 dated Apr. 16, 2019.
Office Action for TW 108105126 dated Jun. 28, 2019.
Written Opinion of the International Searching Authority for PCT/JP2019/005606 (PCT/ISA/237) dated Apr. 16, 2019.

* cited by examiner

NON-ORIENTED ELECTRICAL STEEL SHEET AND METHOD FOR MANUFACTURING NON-ORIENTED ELECTRICAL STEEL SHEET

TECHNICAL FIELD OF THE INVENTION

The present invention relates to a non-oriented electrical steel sheet and a method for manufacturing the non-oriented electrical steel sheet.

Priority is claimed on Japanese Patent Application No. 2018-026109, filed on Feb. 16, 2018, the content of which is incorporated herein by reference.

RELATED ART

Non-oriented electrical steel sheets are used for, for example, motor cores. The non-oriented electrical steel sheets are required to have excellent magnetic characteristics such as a high magnetic flux density. Although various techniques such as those disclosed in Patent Documents 1 to 9 have been proposed, it is difficult to obtain a sufficient magnetic flux density.

PRIOR ART DOCUMENT

Patent Document

[Patent Document 1] Japanese Unexamined Patent Application, First Publication No. H2-133523

[Patent Document 2] Japanese Unexamined Patent Application, First Publication No. H5-140648

[Patent Document 3] Japanese Unexamined Patent Application, First Publication No. H6-057332

[Patent Document 4] Japanese Unexamined Patent Application, First Publication No. 2002-241905

[Patent Document 5] Japanese Unexamined Patent Application, First Publication No. 2004-197217

[Patent Document 6] Japanese Unexamined Patent Application, First Publication No. 2004-332042

[Patent Document 7] Japanese Unexamined Patent Application, First Publication No. 2005-067737

[Patent Document 8] Japanese Unexamined Patent Application, First Publication No. 2011-140683

[Patent Document 9] Japanese Unexamined Patent Application, First Publication No. 2010-1557

DISCLOSURE OF THE INVENTION

Problems to be Solved by the Invention

An object of the invention is to provide a non-oriented electrical steel sheet capable of obtaining a higher magnetic flux density without deterioration of iron loss, and a method for manufacturing the non-oriented electrical steel sheet.

Means for Solving the Problem

The inventors have intensively studied to solve the above-described problems. As a result, it has been found that it is important to make an appropriate relationship between the chemical composition and the crystal orientation. It has also been found that this relationship should be maintained over a whole thickness direction of the non-oriented electrical steel sheet. In general, the isotropy of a texture in a rolled steel sheet is high in a region near a rolled surface, and is reduced as the distance from the rolled surface is increased.

For example, in the invention described in Patent Document 9, the experimental data disclosed in the document shows that the further the measurement position of the texture is away from a surface layer, the lower the isotropy of the texture is. The inventors have found that it is necessary to preferably control the crystal orientation even within the non-oriented electrical steel sheet.

In Patent Document 9, the crystal orientation is accumulated near the cube orientation near the surface layer of the steel sheet, while the gamma fiber texture is developed in the central layer of the steel sheet. Patent Document 9 describes that a novel feature is that the texture greatly differs between the surface layer of the steel sheet and the central layer of the steel sheet. In general, in a case where a rolled steel sheet is annealed and recrystallized, the crystal orientation is accumulated near the {200} and {110} cube orientations near a surface layer of the steel sheet, and the gamma fiber texture {222} is developed in a central layer of the steel sheet. For example, in "Effects of Cold Rolling Conditions on r-Value of Ultra Low Carbon Cold Rolled Steel Sheet", Hashimoto et al., Iron and Steel, Vol. 76, No. 1 (1990), p. 50, in a steel sheet obtained by cold rolling a 0.0035% C-0.12% Mn-0.001% P-0.0084% S-0.03% Al-0.11% Ti steel at a rolling reduction of 73%, and by then annealing the steel sheet for 3 hours at 750° C., (222) is increased, (200) is reduced, and (110) is reduced at a center in a sheet thickness direction as compared to those in a surface layer.

The inventor has found that it is necessary not only to accumulate the crystal orientation near the 12001 cube orientation near the surface layer of the steel sheet, but also to accumulate the crystal orientation near {200} in the central layer of the steel sheet.

It has also been found that in the manufacturing of such a non-oriented electrical steel sheet, it is important to control a columnar grain ratio and an average grain size of a steel strip to be subjected to cold rolling, control a rolling reduction of cold rolling, and control a sheet traveling tension and a cooling rate during final annealing.

The inventors have conducted further intensive studies based on such findings, and as a result, found the following aspects of the invention.

(1) A non-oriented electrical steel sheet according to an aspect of the invention includes, as a chemical composition, by mass %: C: 0.0030% or less; Si: 2.00% or less; Al: 1.00% or less; Mn: 0.10% to 2.00%; S: 0.0030% or less; one or more selected from the group consisting of Mg, Ca, Sr, Ba, Nd, Pr, La, Ce, Zn, and Cd: 0.0015% to 0.0100% in total; a parameter Q represented by Formula 1 where [Si] denotes a Si content (mass %), [Al] denotes an Al content (mass %), and [Mn] denotes a Mn content (mass %):2.00 or less; Sn: 0.00% to 0.40%; Cu: 0.00% to 1.00%; and a remainder: Fe and impurities, and a parameter R represented by Formula 2 where $I_{100}$, $I_{310}$, $I_{411}$, $I_{521}$, $I_{111}$, $I_{211}$, $I_{332}$, and $I_{221}$ denote a {100} crystal orientation intensity, a {310} crystal orientation intensity, a {411} crystal orientation intensity, a {521} crystal orientation intensity, a {111} crystal orientation intensity, a {211} crystal orientation intensity, a {332} crystal orientation intensity, and a {221} crystal orientation intensity in a thickness middle portion, respectively, is 0.80 or greater.

$$Q=[Si]+2\times[Al]-[Mn] \quad \text{(Formula 1)}$$

$$R=(I_{100}+I_{310}+I_{411}+I_{521})/(I_{111}+I_{211}+I_{332}+I_{221}) \quad \text{(Formula 2)}$$

(2) In the non-oriented electrical steel sheet according to (1), in the chemical composition, either Sn: 0.02% to 0.40% or Cu: 0.10% to 1.00%, or both may be satisfied.

(3) A method for manufacturing a non-oriented electrical steel sheet according to another aspect of the invention is a method for manufacturing the non-oriented electrical steel sheet according to (1) or (2), including: continuous casting a molten steel; hot rolling a steel ingot obtained by the continuous casting; cold rolling a steel strip obtained by the hot rolling; and final annealing a cold rolled steel sheet obtained by the cold rolling, in which the molten steel has the chemical composition according to (1) or (2), the steel strip has a columnar grain ratio of 80% or greater by area fraction and an average grain size of 0.10 mm or greater, and a rolling reduction in the cold rolling is 90% or less.

(4) In the method for manufacturing the non-oriented electrical steel sheet according to (3), in the continuous casting, a temperature difference between one surface and the other surface of the steel ingot during solidification may be 40° C. or higher.

(5) In the method for manufacturing the non-oriented electrical steel sheet according to (3) or (4), in the hot rolling, a hot rolling start temperature may be 900° C. or lower, and a coiling temperature for the steel strip may be 650° C. or lower.

(6) In the method for manufacturing the non-oriented electrical steel sheet according to any one of (3) to (5), in the final annealing, a sheet traveling tension may be 3 MPa or less, and a cooling rate from 950° C. to 700° C. may be 1° C./sec or less.

(7) A method for manufacturing a non-oriented electrical steel sheet according to a further aspect of the invention is a method for manufacturing the non-oriented electrical steel sheet according to (1) or (2), including: rapid solidifying a molten steel; cold rolling a steel strip obtained by the rapid solidifying; and final annealing a cold rolled steel sheet obtained by the cold rolling, in which the molten steel has the chemical composition according to (1) or (2), the steel strip has a columnar grain ratio of 80% or greater by area fraction and an average grain size of 0.10 mm or greater, and a rolling reduction in the cold rolling is 90% or less.

(8) In the method for manufacturing the non-oriented electrical steel sheet according to (7), in the rapid solidifying, the molten steel may be solidified by using a moving cooling wall, and a temperature of the molten steel to be injected to the moving cooling wall may be adjusted to be at least 25° C. higher than a solidification temperature of the molten steel.

(9) In the method for manufacturing the non-oriented electrical steel sheet according to (7) or (8), in the rapid solidifying, the molten steel may be solidified by using a moving cooling wall, and an average cooling rate from completion of the solidification of the molten steel to coiling of the steel strip may be 1,000 to 3,000° C./min.

(10) In the method for manufacturing the non-oriented electrical steel sheet according to any one of (7) to (9), a sheet traveling tension in the final annealing may be 3 MPa or less, and a cooling rate from 950° C. to 700° C. may be 1° C./sec or less.

Effects of the Invention

According to the invention, since an appropriate relationship is made between the chemical composition and the crystal orientation, a high magnetic flux density can be obtained without deterioration of iron loss.

EMBODIMENTS OF THE INVENTION

Hereinafter, embodiments of the invention will be described in detail.

First, a chemical composition of a non-oriented electrical steel sheet according to an embodiment of the invention and a molten steel which is used to manufacture the non-oriented electrical steel sheet will be described. Although details thereof will be described later, the non-oriented electrical steel sheet according to the embodiment of the invention is manufactured through casting and hot rolling of a molten steel or rapid solidification of a molten steel, cold rolling, final annealing, and the like. Accordingly, the chemical composition of the non-oriented electrical steel sheet and the molten steel is provided in consideration of not only characteristics of the non-oriented electrical steel sheet, but also the treatments. In the following description, "%", which is a unit of the amount of each element contained in a non-oriented electrical steel sheet or a molten steel, means "mass %" unless otherwise specified. The non-oriented electrical steel sheet according to this embodiment has a chemical composition represented by C: 0.0030% or less, Si: 2.00% or less, Al: 1.00% or less, Mn: 0.10% to 2.00%, S: 0.0030% or less, one or more selected from the group consisting of Mg, Ca, Sr, Ba, Nd, Pr, La, Ce, Zn, and Cd: 0.0015% to 0.0100% in total, a parameter Q represented by Formula 1 where [Si] denotes a Si content (mass %), [Al] denotes an Al content (mass %), and [Mn] denotes a Mn content (mass %): 2.00 or less, Sn: 0.00% to 0.40%, Cu: 0.00% to 1.00%, and a remainder: Fe and impurities. Examples of the impurities include those contained in raw materials such as ores and scraps, and those contained in the manufacturing steps.

$$Q=[Si]+2\times[Al]-[Mn] \quad \text{(Formula 1)}$$

(C: 0.0030% or less)

C increases iron loss, or causes magnetic ageing. Therefore, the lower the C content, the better, and it is not necessary to set the lower limit. The lower limit of the C content may be 0%, 0.0001%, 0.0002%, 0.0005%, or 0.0010%. Such a phenomenon is remarkable in a case where the C content is greater than 0.0030%. Accordingly, the C content is 0.0030% or less. The upper limit of the C content may be 0.0028%, 0.0025%, 0.0022%, or 0.0020%.

(Si: 0.30% or greater and 2.00% or less)

As is well known, Si is a component acting to reduce iron loss, and is contained to exhibit this action. In a case where the Si content is less than 0.30%, the iron loss reducing effect is not sufficiently exhibited. Accordingly the lower limit of the Si content is 0.30%. For example, the lower limit of the Si content may be 0.90%, 0.95%, 0.98%, or 1.00%. In a case where the Si content is increased, the magnetic flux density is reduced. In addition, rolling workability deteriorates, and the cost is also increased. Accordingly, the Si content is 2.0% or less. The upper limit of the Si content may be 1.80%, 1.60%, 1.40%, or 1.10%.

(Al: 1.00% or less)

Similarly to Si, Al has the iron loss reducing effect by increasing electric resistance. In addition, in a case where Al is contained in the non-oriented electrical steel sheet, in the texture obtained by primary recrystallization, a plane parallel to the sheet surface is likely to be a plane in which crystals of a {100} plane (hereinafter, may be referred to as "{100} crystal") are developed. Al is contained to achieve this action. For example, the lower limit of the Al content may be 0%, 0.01%, 0.02%, or 0.03%. In a case where the Al content is greater than 1.00%, the magnetic flux density is reduced as in the case of Si. Accordingly, the Al content is 1.00% or less. The upper limit of the Al content may be 0.50%, 0.20%, 0.10%, or 0.05%.

(Mn: 0.10% to 2.00%)

Mn increases electric resistance, thereby reducing eddy-current loss, and thus reducing iron loss. In a case where Mn is contained, in the texture obtained by primary recrystallization, a plane parallel to the sheet surface is likely to be a plane in which the {100} crystal is developed. The {100} crystal is suitable for uniformly improving magnetic characteristics in all directions within the sheet surface. The higher the Mn content, the higher the MnS precipitation temperature, and the larger the MnS precipitated. Accordingly, the higher the Mn content, the less the fine MnS which hinders recrystallization and grain growth in final annealing and has a grain size of about 100 nm is likely to precipitate. In a case where the Mn content is less than 0.10%, these actions and effects cannot be sufficiently obtained. Accordingly, the Mn content is 0.10% or greater. The lower limit of the Mn content may be 0.12%, 0.15%, 0.18%, or 0.20%. Ina case where the Mn content is greater than 2.00%, the grains are not sufficiently grown in final annealing, and iron loss is increased. Accordingly, the Mn content is 2.00% or less. The upper limit of the Mn content may be 1.00%, 0.50%, 0.30%, or 0.25%.

(S: 0.0030% or less)

S is not an essential element, and is contained as, for example, as an impurity in steel. S hinders recrystallization and grain growth in final annealing by precipitation of fine MnS. Accordingly, the lower the S content, the better. In a case where the S content is greater than 0.0030%, iron loss is remarkably increased. Accordingly, the S content is 0.0030% or less. It is not necessary to particularly specify the lower limit of the S content, and the lower limit of the S content may be, for example, 0%, 0.0005%, 0.0010%, or 0.0015%.

(One Or More Selected from Group Consisting of Mg, Ca, Sr, Ba, Nd, Pr, La, Ce, Zn, and Cd: 0.0015% to 0.0100% in total)

Mg, Ca, Sr, Ba, Nd, Pr, La, Ce, Zn, and Cd react with S in a molten steel during casting or rapid solidification of the molten steel, and form precipitates of sulfides and/or oxysulfides. Hereinafter, Mg, Ca, Sr, Ba, Nd, Pr, La, Ce, Zn, and Cd may be collectively referred to as "coarse precipitate forming element". The grain size of the precipitates of the coarse precipitate forming elements is about 1 μm to 2 μm, which is much larger than the grain size (about 100 nm) of fine precipitates such as MnS, TiN, and AlN. Accordingly, these fine precipitates adhere to the precipitates of the coarse precipitate forming elements, and hardly hinder recrystallization and grain growth in final annealing. In a case where the total amount of the coarse precipitate forming elements is less than 0.0015%, these actions and effects are not stabely obtained. Accordingly, the total amount of the coarse precipitate forming elements is 0.0015% or greater. The lower limit of the total amount of the coarse precipitate forming elements may be 0.0018%, 0.0020%, 0.0022%, or 0.0025%. In a case where the total amount of the coarse precipitate forming elements is greater than 0.0100%, precipitates of sulfides and/or oxysulfides may hinder recrystallization and grain growth in final annealing. Accordingly, the total amount of the coarse precipitate forming elements is 0.0100% or lower. The upper limit of the total amount of the coarse precipitate forming elements may be 0.0095%, 0.0090%, 0.0080%, or 0.0070%.

According to the experimental results of the inventors, as long as the amount of the coarse precipitate forming elements is within the above range, the effect due to the coarse precipitates is reliably exhibited, and the grains of the non-oriented electrical steel sheet are sufficiently grown. Accordingly, it is not necessary to particularly limit the form and components of the coarse precipitates formed by the coarse precipitate forming elements. In the non-oriented electrical steel sheet according to this embodiment, a total mass of S contained in the sulfides or oxysulfides of the coarse precipitate forming element is preferably 40% or greater of a total mass of S contained in the non-oriented electrical steel sheet. As described above, the coarse precipitate forming element reacts with S in a molten steel during casting or rapid solidification of the molten steel, and forms precipitates of sulfides and/or oxysulfides. Accordingly, the fact that the ratio of the total mass of S contained in the sulfides or oxysulfides of the coarse precipitate forming element to the total mass of S contained in the non-oriented electrical steel sheet is high means that a sufficient amount of the coarse precipitate forming elements is contained in the non-oriented electrical steel sheet, and fine precipitates such as MnS are effectively adhered to the precipitates. Accordingly, the higher the above ratio, the further the recrystallization and the grain growth in final annealing are promoted, and excellent magnetic characteristics are obtained. The above ratio can be achieved by, for example, controlling manufacturing conditions during casting or rapid solidification of the molten steel as described below.

(Parameter Q: 2.00 or Less)

The parameter Q is a value represented by Formula 1 where [Si] denotes a Si content (mass %), [Al] denotes an Al content (mass %), and [Mn] denotes a Mn content (mass %).

$$Q=[Si]+2\times[Al]-[Mn] \quad \text{(Formula 1)}$$

By adjusting the parameter Q to 2.00 or less, transformation from austenite to ferrite ($\gamma\rightarrow\alpha$ transformation) is likely to occur during cooling after continuous casting or rapid solidification of the molten steel, and the {100}<0vw> texture of columnar grains is further sharpened. The upper limit of the parameter Q may be 1.50%, 1.20%, 1.00%, 0.90%, or 0.88%. There is no need to particularly limit the lower limit of the parameter Q, and the lower limit may be, for example, 0.20%, 0.40%, 0.80%, 0.82%, or 0.85%.

Sn and Cu are not essential elements, and the lower limit of the content thereof is 0%. Sn and Cu are optional elements which may be appropriately contained in a predetermined amount in the non-oriented electrical steel sheet.

(Sn: 0.00% to 0.40%, Cu: 0.00% to 1.00%)

Sn and Cu develop crystals suitable for improving magnetic characteristics in primary recrystallization. Accordingly, in a case where Sn and/or Cu are contained, a texture in which the {100} crystal suitable for uniformly improving magnetic characteristics in all directions within the sheet surface has been developed is easily obtained in primary recrystallization. Sn suppresses oxidation and nitriding of the surface of the steel sheet during final annealing, or suppresses variation in the size of grains. Accordingly, Sn and/or Cu may be contained. In order to sufficiently obtain these actions and effects, Sn is preferably 0.02% or greater and/or Cu is preferably 0.10% or greater. The lower limit of the Sn content may be 0.05%, 0.08%, or 0.10%. The lower limit of the Cu content may be 0.12%, 0.15%, or 0.20%. In a case where the Sn content is greater than 0.40%, the above-described actions and effects are saturated, and thus the cost is uselessly increased, or grain growth in final annealing is suppressed. Accordingly, the Sn content is 0.40% or less. The upper limit of the Sn content may be 0.35%, 0.30%, or 0.20%. In a case where the Cu content is greater than 1.00%, the steel sheet embrittles, and thus it becomes difficult to perform hot rolling and cold rolling, or it becomes difficult to pass the sheet through an annealing line of final annealing. Accordingly, the Cu content is 1.00% or less. The upper limit of the Cu content may be 0.80%, 0.60%, or 0.40%.

Next, the texture of the non-oriented electrical steel sheet according to the embodiment of the invention will be described. In the non-oriented electrical steel sheet according to this embodiment, a parameter R represented by Formula 2 where $I_{100}$, $I_{310}$, $I_{411}$, $I_{521}$, $I_{111}$, $I_{211}$, $I_{332}$, and $I_{221}$ denote a {100} crystal orientation intensity, a {310} crystal orientation intensity, a {411} crystal orientation intensity, a {521} crystal orientation intensity, a {111} crystal orientation intensity, a {211} crystal orientation intensity, a {332} crystal orientation intensity, and a {221} crystal orientation intensity in a thickness middle portion, respectively, is 0.80 or greater. The thickness middle portion (generally may be referred to as a ½T portion) means a region at a depth of about ½ of a sheet thickness T of the non-oriented electrical steel sheet from the rolled surface of the non-oriented electrical steel sheet. In other words, the thickness middle portion means an intermediate plane between both rolled surfaces of the non-oriented electrical steel sheet and a region therearound.

$$R=(I_{100}+I_{310}+I_{411}+I_{521})/(I_{111}+I_{121}+I_{332}+I_{221}) \quad \text{(Formula 2)}$$

{310}, {411}, and {521} are near {100}, and the sum of $I_{100}$, $I_{310}$, $I_{411}$, and $I_{521}$ is the sum of the crystal orientation intensities of a portion near {100}, including {100} itself. {211}, {332}, and {221} are near {111}, and the sum of $I_{111}$, $I_{211}$, $I_{332}$, and $I_{221}$ is the sum of the crystal orientation intensities of a portion near {111}, including {111} itself. In a case where the parameter R in the thickness middle portion is less than 0.80, magnetic characteristics deteriorate, such that the magnetic flux density is reduced or iron loss is increased. Accordingly, in this component system, in a case where the thickness is, for example, 0.50 mm, magnetic characteristics represented by a magnetic flux density B50 in the rolling direction (L-direction): 1.79 T or greater, an average value $B50_{L+C}$ of magnetic flux densities B50 in the rolling direction and in the width direction (C-direction): 1.75 T or greater, iron loss $W15/50_L$ in the rolling direction: 4.5 W/kg or less, and an average value $W15/50_{L+C}$ of iron loss W15/50 in the rolling direction and in the width direction: 5.0 W/kg or less cannot be exhibited. The parameter R in the thickness middle portion can be adjusted to a desired value by adjusting, for example, a difference between the temperature at which the molten steel is poured to a surface of a moving cooling wall and a solidification temperature of the molten steel, a temperature difference between one surface and the other surface of the cast piece during solidification, the amount of sulfides or oxysulfides formed, a cold rolling ratio, and the like. The lower limit of the parameter R in the thickness middle portion may be 0.82, 0.85, 0.90, or 0.95. The higher the parameter R in the thickness middle portion, the better. Accordingly, it is not necessary to specify the upper limit of the parameter R, and the upper limit may be, for example, 2.00, 1.90, 1.80, or 1.70.

The crystal orientation of the non-oriented electrical steel sheet according to this embodiment is required to be controlled as described above in the whole sheet. However, the isotropy of the texture in the rolled steel sheet is high in a region near the rolled surface, and is generally reduced as the distance from the rolled surface is increased. For example, in "Effects of Cold Rolling Conditions on r-Value of Ultra Low Carbon Cold Rolled Steel Sheet", Hashimoto et al., Iron and Steel, Vol. 76, No. 1 (1990), p. 50, in a steel sheet obtained by cold rolling a 0.0035% C-0.12% Mn-0.001% P-0.0084% S-0.03% Al-0.11% Ti steel at a rolling reduction of 73%, and by then annealing the steel sheet for 3 hours at 750° C., (222) is increased, (200) is reduced, and (110) is reduced at a center in a sheet thickness direction as compared to those in a surface layer.

Accordingly, in a case where the parameter R is 0.8 or greater in the thickness middle portion, which is farthest from the rolled surface, a same or higher degree of isotropy can be achieved in other regions. For the above reasons, the crystal orientation of the non-oriented electrical steel sheet according to this embodiment is specified in the thickness middle portion.

The {100} crystal orientation intensity, the {310} crystal orientation intensity, the {411} crystal orientation intensity, the {521} crystal orientation intensity, the {111} crystal orientation intensity, the {211} crystal orientation intensity, the {332} crystal orientation intensity, and the {221} crystal orientation intensity in the thickness middle portion can be measured by an X-ray diffraction method (XRD) or an electron backscatter diffraction (EBSD) method. Specifically, a plane parallel to the rolled surface of the non-oriented electrical steel sheet at a depth of about ½ of the sheet thickness T from the rolled surface is exposed by a normal method and subjected to XRD analysis or EBSD analysis to measure each crystal orientation intensity, and the parameter R in the thickness middle portion can be calculated. Since the diffraction intensity of X-rays and electron beams from a sample differs for each crystal orientation, the crystal orientation intensity can be obtained based on a relative ratio with respect to a random orientation sample.

Next, the magnetic characteristics of the non-oriented electrical steel sheet according to the embodiment of the invention will be described. In a case where the non-oriented electrical steel sheet according to this embodiment has, for example, a thickness of 0.50 mm, the non-oriented electrical steel sheet can exhibit magnetic characteristics represented by a magnetic flux density $B50_L$ in the rolling direction (L-direction): 1.79 T or greater, an average value $B50_{L+C}$ of magnetic flux densities B50 in the rolling direction and in the width direction (C-direction): 1.75 T or greater, iron loss $W15/50_L$ in the rolling direction: 4.5 W/kg or less, and an average value $W15/50_{L+C}$ of iron loss W15/50 in the rolling direction and in the width direction: 5.0 W/kg or less. The magnetic flux density B50 is a magnetic flux density in a magnetic field of 5,000 A/m, and the iron loss W15/50 is iron loss at a magnetic flux density of 1.5 T and a frequency of 50 Hz.

Next, an example of a method for manufacturing a non-oriented electrical steel sheet according to this embodiment will be described. It goes without saying that the method for manufacturing a non-oriented electrical steel sheet according to this embodiment is not particularly limited. A non-oriented electrical steel sheet satisfying the above requirements corresponds to the non-oriented electrical steel sheet according this embodiment even in a case where it is obtained by a method other than the manufacturing method to be exemplified below.

First, a first method for manufacturing a non-oriented electrical steel sheet according to this embodiment will be illustratively described. In the first manufacturing method, continuous casting of a molten steel, hot rolling, cold rolling, final annealing, and the like are performed.

In casting and hot rolling of a molten steel, a molten steel having the above chemical composition is cast to produce a steel ingot such as a slab, and the hot rolling is performed to obtain a steel strip having a columnar grain ratio of 80% or greater by area fraction and an average grain size of 0.10 mm or greater. In solidification, in a case where a temperature difference between the outermost surface and the inside of the steel ingot, or a temperature difference between one surface and the other surface of the steel ingot is sufficiently large, the grains solidified in the surface of the steel ingot are grown in a direction perpendicular to the surface to form columnar grains. In a steel having a BCC structure, columnar grains are grown such that the {100} plane is parallel to the surface of the steel ingot. In a case where, before development of the columnar grains from the surface to the center of the steel ingot or from one surface to the other surface of the steel ingot, the temperature inside the steel ingot or the temperature of the other surface of the steel ingot decreases and reaches to a solidification temperature, crystallization is started inside the steel ingot or in the other surface of the steel ingot. The crystals crystallized inside the steel ingot or in the other surface of the steel ingot are equiaxially grown and have a crystal orientation different from that of the columnar grains.

For example, a columnar grain ratio can be measured according to the following procedure. First, a cross section of the steel strip is polished and etched with a picric acid-based corrosion solution to expose a solidification structure. Here, the cross section of the steel strip may be an L-cross section parallel to a longitudinal direction of the steel strip or a C-cross section perpendicular to the longitudinal direction of the steel strip, and the L-cross section is generally used. In this cross section, in a case where dendrite develops in the sheet thickness direction and penetrates the whole sheet thickness, the columnar grain ratio is determined to be 100%. In a case where a granular black structure (equiaxial grains) other than dendrite is visible in the cross section, a value obtained by subtracting the thickness of the granular structure from the overall thickness of the steel sheet and by dividing the result of the subtraction by the overall thickness of the steel sheet is defined as a columnar grain ratio of the steel sheet.

In the first manufacturing method, $\gamma \rightarrow \alpha$ transformation is likely to occur during cooling after continuous casting of the molten steel, and a crystal structure that has undergone $\gamma \rightarrow \alpha$ transformation from the columnar grains is also regarded as columnar grains. By undergoing $\gamma \rightarrow \alpha$ transformation, the {100}<0vw> texture of the columnar grains is further sharpened.

The columnar grains have a {100}<0vw> texture desirable for a uniform improvement of the magnetic characteristics of the non-oriented electrical steel sheet, particularly, the magnetic characteristics in all directions within the sheet surface. The {100}<0vw> texture is a texture in which the crystal, in which plane parallel to the sheet surface is a {100} plane and in which rolling direction is in a <0vw> orientation, is developed (each of v and w is any real number (except for a case where both of v and w are 0)). In a case where the columnar grain ratio is less than 80%, it is not possible to obtain a texture in which the {100} crystal is developed by final annealing over the whole sheet thickness direction of the non-oriented electrical steel sheet. In that case, as described above, the {100} crystal is not developed in the thickness middle portion of the steel sheet, whereas the {111} crystal unfavorable for the magnetic characteristics is developed. In order to obtain a texture in which the {100} crystal is developed up to the thickness middle portion of the steel sheet, the columnar grain ratio of the steel strip is 80% or greater. As described above, the columnar grain ratio of the steel strip can be specified by observing the cross section of the steel strip with a microscope. However, the columnar grain ratio of the steel strip cannot be accurately measured after cold rolling or a heat treatment to be described later is performed on the steel strip. Accordingly, in the non-oriented electrical steel sheet according to this embodiment, the columnar grain ratio is not particularly specified.

In the first manufacturing method, for example, a temperature difference between one surface and the other surface of the steel ingot such as a cast piece during solidification is adjusted to 40° C. or greater in order to adjust the columnar grain ratio to 80% or greater. This temperature difference can be controlled by a cooling structure, a material, a mold taper, a mold flux, and the like of the mold. In a case where a molten steel is cast under the condition that the columnar grain ratio is 80% or greater, sulfides and/or oxysulfides of Mg, Ca, Sr, Ba, Nd, Pr, La, Ce, Zn, or Cd are easily formed, and formation of fine sulfides such as MnS is suppressed.

The smaller the average grain size of the steel strip, the larger the number of grains and the wider the area of grain boundaries. In recrystallization in final annealing, crystals are grown from the inside of the grains and from the grain boundaries, in which the crystal grown from the inside of the grain is the {100} crystal desirable for the magnetic characteristics, and on the contrary, the crystal grown from the grain boundary is the crystal undesirable for the magnetic characteristics, such as a {111}<112> crystal. Therefore, the larger the average grain size of the steel strip, the more the {100} crystal desirable for the magnetic characteristics is likely to develop in final annealing, and particularly, in a case where the average grain size of the steel strip is 0.10 mm or greater, excellent magnetic characteristics are likely to be obtained. Therefore, the average grain size of the steel strip is 0.10 mm or greater. The average grain size of the steel strip can be adjusted by a temperature difference between the two surfaces of the cast piece during casting, an average cooling rate within a temperature range of 700° C. or higher, a hot rolling start temperature, a coiling temperature, and the like. In a case where the temperature difference between the two surfaces of the cast piece during casting is 40° C. or higher and the average cooling rate at 700° C. or higher is 10° C./min or less, a steel strip in which the average grain size of columnar grains contained in the steel strip is 0.10 mm or greater is obtained. Furthermore, in a case where the hot rolling start temperature is 900° C. or lower and the coiling temperature is 650° C. or lower, the grains contained in the steel strip are not recrystallized and are extended, and thus a steel strip whose average grain diameter is 0.10 mm or greater is obtained. The average cooling rate within a temperature range of 700° C. or higher is an average cooling rate within a temperature range from a casting start temperature to 700° C., and is a value obtained by dividing a difference between the casting start temperature and 700° C. by a time required for cooling from the casting start temperature to 700° C.

Preferably, a coarse precipitate forming element is placed on a bottom of a final pot before casting in the steelmaking process, and a molten steel containing an element other than the coarse precipitate forming element is poured into the pot to dissolve the coarse precipitate forming element in the molten steel. Accordingly, it is possible to make it difficult for the coarse precipitate forming element to be scattered from the molten steel, and to promote the reaction between the coarse precipitate forming element and S. The final pot before casting in the steelmaking process is, for example, a pot directly above a tundish of a continuous casting machine.

In a case where the rolling reduction of cold rolling is greater than 90%, a texture which hinders an improvement of the magnetic characteristics, such as a {111}<112> texture, is likely to develop during final annealing. Accordingly, the rolling reduction of cold rolling is 90% or less. In a case where the rolling reduction of cold rolling is less than 40%, it may be difficult to secure thickness accuracy and flatness of the non-oriented electrical steel sheet. Accordingly, the rolling reduction of cold rolling is preferably 40% or greater.

By final annealing, primary recrystallization and grain growth are caused, and the average grain size is adjusted to 50 μm to 180 μm. By this final annealing, a texture in which the {100} crystal suitable for uniformly improving the magnetic characteristics in all directions within the sheet surface is developed is obtained. In final annealing, for example, the holding temperature is 750° C. to 950° C., and the holding time is 10 seconds to 60 seconds.

In a case where a sheet traveling tension during final annealing is greater than 3 MPa, an anisotropic elastic strain may be likely to remain in the non-oriented electrical steel sheet. The anisotropic elastic strain deforms the texture. Accordingly, even in a case where the texture in which the {100} crystal is developed is obtained, the texture may be deformed, and uniformity of the magnetic characteristics within the sheet surface may be lowered. Therefore, the sheet traveling tension during final annealing is preferably 3 MPa or less. Even in a case where a cooling rate between 950° C. and 700° C. during final annealing is greater than 1° C./s, the anisotropic elastic strain is likely to remain in the non-oriented electrical steel sheet. Therefore, the cooling rate between 950° C. and 700° C. during final annealing is preferably 1° C./s or less. Here, the cooling rate is different from the average cooling rate (a value obtained by dividing a difference between a cooling start temperature and a cooling finishing temperature by a time required for cooling). In consideration of the necessity of always keeping the cooling rate low, the cooling rate is required to be always 1° C./s or less within the temperature range of 950° C. to 700° C. in final annealing.

In this manner, the non-oriented electrical steel sheet according to this embodiment can be manufactured. After the final annealing, an insulating coating may be formed by coating and baking.

Next, a second method for manufacturing a non-oriented electrical steel sheet according to the embodiment will be described. In the second manufacturing method, rapid solidification of a molten steel, cold rolling, final annealing and the like are performed.

In rapid solidification of a molten steel, a molten steel having the above chemical composition is rapidly solidified on a surface of a moving cooling wall, and a steel strip in which the columnar grain ratio is 80% or greater by area fraction and the average grain size is 0.10 inn or greater is obtained. In the second manufacturing method, $\gamma \rightarrow \alpha$ transformation is likely to occur during cooling after the rapid solidification of the molten steel, and a crystal structure that has undergone $\gamma \rightarrow \alpha$ transformation from the columnar grains is also regarded as columnar grains. By undergoing $\gamma \rightarrow \alpha$ transformation, the {100}<0vw> texture of the columnar grains is further sharpened.

The columnar grains have a {100}<0vw> texture desirable for a uniform improvement of the magnetic characteristics of the non-oriented electrical steel sheet, particularly, the magnetic characteristics in all directions within the sheet surface. The {100}<0vw> texture is a texture in which the crystal, in which plane parallel to the sheet surface is a {100} plane and in which rolling direction is in a <0vw> orientation, is developed (each of v and w is any real number (except for a case where both of v and w are 0)). In a case where the columnar grain ratio is less than 80%, it is not possible to obtain a texture in which the {100} crystal is developed by final annealing over the whole sheet thickness direction of the non-oriented electrical steel sheet. In that case, as described above, the {100} crystal is not developed in the thickness middle portion of the steel sheet, whereas the {111} crystal unfavorable for the magnetic characteristics is developed. In order to obtain a texture in which the {100} crystal is developed up to the thickness middle portion of the steel sheet, the columnar grain ratio of the steel strip is 80% or greater. The columnar grain ratio of the steel strip can be specified by microscopic observation as described above.

In the second manufacturing method, for example, a temperature at which the molten steel is poured to a surface of a moving cooling wall is increased by 25° C. or higher than the solidification temperature in order to adjust the columnar grain ratio to 80% or greater. Particularly, in a case where the temperature of the molten steel is increased by 40° C. or higher than the solidification temperature, the columnar grain ratio can be adjusted to substantially 100%. In a case where the molten steel is solidified under the condition that the columnar grain ratio is 80% or greater, sulfides and/or oxysulfides of Mg, Ca, Sr, Ba, Nd, Pr, La, Ce, Zn, or Cd are easily formed. In addition, formation of fine sulfides such as MnS is suppressed.

The smaller the average grain size of the steel strip, the larger the number of grains and the wider the area of grain boundaries. In recrystallization in final annealing, crystals are grown from the inside of the grains and from the grain boundaries, in which the crystal grown from the inside of the grain is the {100} crystal desirable for the magnetic characteristics, and on the contrary, the crystal grown from the grain boundary is the crystal undesirable for the magnetic characteristics, such as a {111}<112> crystal. Therefore, the larger the average grain size of the steel strip, the more the {100} crystal desirable for the magnetic characteristics is likely to develop in final annealing, and particularly, in a case where the average grain size of the steel strip is 0.10 mm or greater, excellent magnetic characteristics are likely to be obtained. Therefore, the average grain size of the steel strip is 0.10 mm or greater. The average grain size of the steel strip can be adjusted by an average cooling rate from completion of the solidification during rapid solidification to winding, and the like. Specifically, the average cooling rate from completion of the solidification of the molten steel to coiling of the steel strip is 1,000 to 3,000° C./min.

During rapid solidification, preferably, the coarse precipitate forming element is placed on a bottom of a final pot before casting in the steelmaking process, and a molten steel containing an element other than the coarse precipitate forming element is poured into the pot to dissolve the coarse precipitate forming element in the molten steel. Accordingly, it is possible to make it difficult for the coarse precipitate forming element to be scattered from the molten steel, and to promote the reaction between the coarse precipitate forming element and S. The final pot before casting in the steelmaking process is, for example, a pot directly above the tundish of the casting machine for rapid solidification.

In a case where the rolling reduction of cold rolling is greater than 90%, a texture which hinders an improvement of the magnetic characteristics, such as a {111}<112> texture, is likely to develop during final annealing. Accordingly, the rolling reduction of cold rolling is 90% or less. In a case where the rolling reduction of cold rolling is less than 40%, it may be difficult to secure thickness accuracy and flatness of the non-oriented electrical steel sheet. Accordingly, the rolling reduction of cold rolling is preferably 40% or greater.

By final annealing, primary recrystallization and grain growth are caused, and the average grain size is adjusted to 50 μm to 180 m. By this final annealing, a texture in which the {100} crystal suitable for uniformly improving the magnetic characteristics in all directions within the sheet surface is developed is obtained. In final annealing, for example, the holding temperature is 750° C. to 950° C., and the holding time is 10 seconds to 60 seconds.

In a case where a sheet traveling tension during final annealing is greater than 3 MPa, an anisotropic elastic strain may be likely to remain in the non-oriented electrical steel sheet. The anisotropic elastic strain deforms the texture. Accordingly, even in a case where the texture in which the {100} crystal is developed is obtained, the texture may be deformed, and uniformity of the magnetic characteristics within the sheet surface may be lowered. Therefore, the sheet traveling tension during final annealing is preferably 3 MPa or less. Even in a case where a cooling rate between 950° C. and 700° C. during final annealing is greater than 1° C./s, the anisotropic elastic strain may be likely to remain in the non-oriented electrical steel sheet. Therefore, the cooling rate between 950° C. and 700° C. during final annealing is preferably 1° C./s or less. Here, the "cooling rate" is different from the "average cooling rate" (a value obtained by dividing a difference between a cooling start temperature and a cooling finishing temperature by a time required for cooling). In consideration of the necessity of always keeping the cooling rate low, the cooling rate is required to be always 1° C./s or less within the temperature range of 950° C. to 700° C. in final annealing.

In this manner, the non-oriented electrical steel sheet according to this embodiment can be manufactured. After the final annealing, an insulating coating may be formed by applying and baking.

For example, in a case where the non-oriented electrical steel sheet according to this embodiment has a thickness of 0.50 mm, it has magnetic characteristics such as a high magnetic flux density and low iron loss represented by a magnetic flux density $B50_L$ in the rolling direction (L-direction): 1.79 T or greater, an average value $B50_{L+C}$ of magnetic flux densities B50 in the rolling direction and in the width direction (C-direction): 1.75 T or greater, iron loss $W15/50_L$ in the rolling direction: 4.5 W/kg or less, and an average value $W15/50_{L+C}$ of iron loss W15/50 in the rolling direction and in the width direction: 5.0 W/kg or less.

Although the preferable embodiments of the invention have been described in detail, the invention is not limited to such examples. It is apparent that a person having common knowledge in the technical field to which the invention belongs is able to devise various changes or modifications within the scope of the technical idea described in the claims, and it should be understood that such examples belong to the technical scope of the invention as a matter of course.

EXAMPLES

Next, the non-oriented electrical steel sheet according to the embodiment of the invention will be described in detail with reference to examples. The following examples are merely examples of the non-oriented electrical steel sheet according to the embodiment of the invention, and the non-oriented electrical steel sheet according to the invention is not limited to the following examples.

(First Test)

In a first test, slabs were produced by casting a molten steel having a chemical composition shown in Table 1, and the slabs were hot rolled to obtain steel strips. In Table 1, the blank indicates that the amount of the corresponding element is less than the detection limit, and the remainder consists of Fe and impurities. In Table 1, the underline indicates that the numerical value is out of the range of the invention. Next, the steel strips were cold rolled and subjected to final annealing to produce various non-oriented electrical steel sheets having a thickness of 0.50 mm. The crystal orientation intensity in a thickness middle portion of each non-oriented electrical steel sheet was measured, and a parameter R in the thickness middle portion was calculated. Table 2 shows the results thereof. In Table 2, the underline indicates that the numerical value is out of the range of the invention.

TABLE 1

| Steel | Chemical Composition (mass %) | | | | | | | | |
|---|---|---|---|---|---|---|---|---|---|
| Symbol | C | Si | Al | Mn | S | Mg | Ca | Sr | Ba |
| A | 0.0014 | 1.02 | 0.03 | 0.20 | 0.0022 | | | 0.0020 | |
| B | 0.0013 | 1.05 | 0.02 | 0.18 | 0.0020 | | | 0.0034 | |
| C | 0.0021 | 1.04 | 0.03 | 0.17 | 0.0019 | | | | 0.0043 |
| D | 0.0025 | 1.00 | 0.03 | 0.18 | 0.0023 | | | | 0.0039 |
| E | 0.0018 | 1.03 | 0.04 | 0.22 | 0.0024 | | | | |
| F | 0.0019 | 0.98 | 0.04 | 0.17 | 0.0016 | | | | |
| G | 0.0011 | 1.07 | 0.03 | 0.26 | 0.0035 | | 0.0019 | | |
| H | 0.0021 | 1.02 | 0.03 | 0.21 | 0.0020 | | 0.0012 | | |
| I | 0.0022 | 1.01 | 0.03 | 0.19 | 0.0018 | | 0.0147 | | |
| J | 0.0020 | 2.46 | 0.02 | 0.22 | 0.0027 | 0.0027 | | | |
| K | 0.0018 | 1.05 | 0.03 | 0.24 | 0.0022 | 0.0021 | | | |
| L | 0.0016 | 1.09 | 0.03 | 0.21 | 0.0019 | | 0.0041 | | |
| M | 0.0016 | 0.98 | 0.04 | 0.22 | 0.0021 | | | 0.0028 | |
| N | 0.0020 | 1.00 | 0.03 | 0.22 | 0.0018 | | | | 0.0035 |
| O | 0.0019 | 1.02 | 0.02 | 0.21 | 0.0017 | | | | |
| P | 0.0017 | 1.02 | 0.02 | 0.24 | 0.0024 | | | | |
| Q | 0.0021 | 1.01 | 0.04 | 0.21 | 0.0022 | | | | |
| R | 0.0024 | 1.07 | 0.02 | 0.22 | 0.0015 | | | | |
| S | 0.0022 | 1.05 | 0.02 | 0.24 | 0.0018 | | | | |
| T | 0.0018 | 1.03 | 0.003 | 0.21 | 0.0017 | | | | |

TABLE 1-continued

| | | | | | | |
|---|---|---|---|---|---|---|
| A2 | 0.0029 | 1.98 | 0.03 | 1.98 | 0.0010 | |
| A3 | 0.0010 | 0.34 | 0.98 | 1.42 | 0.0017 | 0.0038 |

| Steel Symbol | Chemical Composition (mass %) La | Ce | Zn | Cd | Sn | Cu | Total Content of Coarse Precipitate Forming Elements | Parameter Q |
|---|---|---|---|---|---|---|---|---|
| A | | | | | | | 0.0020 | 0.88 |
| B | | | | | | | 0.0034 | 0.91 |
| C | | | | | | | 0.0043 | 0.93 |
| D | | | | | | | 0.0039 | 0.88 |
| E | | 0.0078 | | | | | 0.0078 | 0.89 |
| F | | | 0.0043 | | | | 0.0043 | 0.89 |
| G | | | | | | | 0.0019 | 0.87 |
| H | | | | | | | 0.0012 | 0.87 |
| I | | | | | | | 0.0147 | 0.88 |
| J | | | | | | | 0.0027 | 2.28 |
| K | | | | | | | 0.0021 | 0.87 |
| L | | | | | | | 0.0041 | 0.94 |
| M | | | | | | | 0.0028 | 0.84 |
| N | | | | | | | 0.0035 | 0.84 |
| O | | 0.0063 | | | | | 0.0063 | 0.85 |
| P | | | 0.0054 | | | | 0.0054 | 0.82 |
| Q | | | | 0.0038 | | | 0.0038 | 0.88 |
| R | | | | 0.0042 | 0.14 | | 0.0042 | 0.89 |
| S | | | | 0.0039 | | 0.32 | 0.0039 | 0.85 |
| T | 0.0035 | 0.0044 | | | | | 0.0079 | 0.83 |
| A2 | | | | 0.0062 | | | 0.0062 | 0.06 |
| A3 | | | | | | | 0.0038 | 0.88 |

TABLE 2

| Sample No. | Steel Symbol | Crystal Orientation Intensity I $I_{100}$ | $I_{310}$ | $I_{411}$ | $I_{521}$ | $I_{111}$ | $I_{211}$ | $I_{332}$ | $I_{221}$ | Parameter R | Remarks |
|---|---|---|---|---|---|---|---|---|---|---|---|
| 1 | A | 1.03 | 0.88 | 0.68 | 0.43 | 2.01 | 2.33 | 0.48 | 1.29 | 0.49 | Comparative Example |
| 2 | B | 1.12 | 1.05 | 0.79 | 0.61 | 1.63 | 1.94 | 0.39 | 1.14 | 0.70 | Comparative Example |
| 3 | C | 0.85 | 0.77 | 0.47 | 0.31 | 2.25 | 1.56 | 0.64 | 1.78 | 0.39 | Comparative Example |
| 4 | D | 1.06 | 0.82 | 0.62 | 0.57 | 2.01 | 1.32 | 0.53 | 1.44 | 0.58 | Comparative Example |
| 5 | E | 1.11 | 1.23 | 1.08 | 0.52 | 2.21 | 1.65 | 0.99 | 1.22 | 0.65 | Comparative Example |
| 6 | F | 0.98 | 0.89 | 1.05 | 0.29 | 1.99 | 1.78 | 0.67 | 1.02 | 0.59 | Comparative Example |
| 7 | G | 1.14 | 1.01 | 0.39 | 0.44 | 1.78 | 1.42 | 0.95 | 1.07 | 0.57 | Comparative Example |
| 8 | H | 1.27 | 0.92 | 0.66 | 0.92 | 1.38 | 1.58 | 0.82 | 1.31 | 0.74 | Comparative Example |
| 9 | I | 1.19 | 0.88 | 0.45 | 0.70 | 1.58 | 1.49 | 0.54 | 1.14 | 0.68 | Comparative Example |
| 10 | J | 1.17 | 1.04 | 0.69 | 0.66 | 1.49 | 1.35 | 0.68 | 1.33 | 0.73 | Comparative Example |
| 11 | K | 1.59 | 0.92 | 0.83 | 0.78 | 0.97 | 1.29 | 0.48 | 0.99 | 1.10 | Inventive Example |
| 12 | L | 1.62 | 1.06 | 1.01 | 0.66 | 0.88 | 1.36 | 0.37 | 1.22 | 1.14 | Inventive Example |
| 13 | M | 1.44 | 1.22 | 0.89 | 0.71 | 1.02 | 1.16 | 0.29 | 1.08 | 1.20 | Inventive Example |
| 14 | N | 1.92 | 0.69 | 0.95 | 0.83 | 1.35 | 1.62 | 0.44 | 1.29 | 0.93 | Inventive Example |
| 15 | O | 1.55 | 0.88 | 1.21 | 0.87 | 0.87 | 1.00 | 0.31 | 1.45 | 1.24 | Inventive Example |
| 16 | P | 2.04 | 0.77 | 1.33 | 0.53 | 1.38 | 1.77 | 0.69 | 1.85 | 0.82 | Inventive Example |
| 17 | Q | 1.88 | 1.31 | 1.04 | 0.75 | 1.09 | 0.98 | 0.27 | 1.23 | 1.39 | Inventive Example |
| 18 | R | 2.63 | 1.05 | 1.93 | 0.43 | 0.66 | 0.68 | 0.66 | 1.15 | 1.92 | Inventive Example |
| 19 | S | 2.47 | 0.99 | 1.68 | 0.55 | 0.78 | 0.82 | 0.62 | 1.12 | 1.70 | Inventive Example |
| 20 | T | 1.98 | 1.11 | 1.52 | 0.65 | 0.73 | 0.78 | 0.59 | 1.08 | 1.65 | Inventive Example |
| 21 | A2 | 2.11 | 1.19 | 1.23 | 1.04 | 0.88 | 1.15 | 0.67 | 0.96 | 1.52 | Inventive Example |
| 22 | A3 | 1.39 | 0.96 | 1.35 | 1.00 | 1.55 | 0.64 | 1.18 | 1.69 | 0.93 | Inventive Example |

The magnetic characteristics of each non-oriented electrical steel sheet were measured. Table 3 shows the results thereof. In Table 3, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 3

| Sample No. | $W15/50_L$ (W/kg) | $W15/50_{L+C}$ (W/kg) | $B50_L$ (T) | $B50_{L+C}$ (T) | Mass ratio of S | Remarks |
|---|---|---|---|---|---|---|
| 1 | 5.3 | 5.7 | 1.73 | 1.71 | 30 | Comparative Example |
| 2 | 4.9 | 5.3 | 1.76 | 1.73 | 60 | Comparative Example |
| 3 | 5.4 | 5.7 | 1.73 | 1.70 | 50 | Comparative Example |
| 4 | 5.3 | 5.6 | 1.74 | 1.72 | 40 | Comparative Example |
| 5 | 5.1 | 5.4 | 1.75 | 1.71 | 70 | Comparative Example |
| 6 | 5.2 | 5.5 | 1.74 | 1.70 | 90 | Comparative Example |
| 7 | 5.2 | 5.6 | 1.74 | 1.71 | 30 | Comparative Example |
| 8 | 5.2 | 5.5 | 1.77 | 1.73 | 20 | Comparative Example |
| 9 | 5.0 | 5.3 | 1.75 | 1.72 | 90 | Comparative Example |
| 10 | 3.5 | 3.8 | 1.73 | 1.69 | 90 | Comparative Example |
| 11 | 4.2 | 4.5 | 1.81 | 1.78 | 90 | Inventive Example |
| 12 | 4.2 | 4.4 | 1.81 | 1.78 | 90 | Inventive Example |
| 13 | 4.1 | 4.4 | 1.82 | 1.79 | 50 | Inventive Example |
| 14 | 4.4 | 4.7 | 1.79 | 1.77 | 50 | Inventive Example |
| 15 | 4.1 | 4.3 | 1.82 | 1.80 | 90 | Inventive Example |
| 16 | 4.4 | 4.8 | 1.79 | 1.76 | 80 | Inventive Example |
| 17 | 4.1 | 4.3 | 1.81 | 1.79 | 50 | Inventive Example |
| 18 | 3.8 | 4.1 | 1.83 | 1.81 | 80 | Inventive Example |
| 19 | 4.0 | 4.2 | 1.83 | 1.80 | 60 | Inventive Example |
| 20 | 3.9 | 4.1 | 1.82 | 1.80 | 90 | Inventive Example |
| 21 | 3.9 | 4.2 | 1.81 | 1.79 | 90 | Inventive Example |
| 22 | 4.2 | 4.4 | 1.82 | 1.80 | 80 | Inventive Example |

As shown in Table 3, in Sample Nos. 11 to 22, the chemical composition was within the range of the invention, and the parameter R in the thickness middle portion was within the range of the invention. Accordingly, good magnetic characteristics were obtained.

In Sample Nos. 1 to 6, since the parameter R in the thickness middle portion was excessively low, the iron loss $W15/50_L$ and the average value $W/50_{L+C}$ were high, and the magnetic flux density $B50_L$ and the average value $B50_{L+C}$ were low. In Sample No. 7, since the S content was excessively high, the ratio of the total mass of S contained in the sulfides or oxysulfides of the coarse precipitate forming element to the total mass of S contained in the non-oriented electrical steel sheet (which is described as "mass ratio of S" in Table 3) was less than 40%, the iron loss $W15/50_L$ and the average value $W15/50_{L+C}$ were high, and the magnetic flux density $B50_L$ and the average value $B50_{L+C}$ were low. In Sample No. 8, since the total amount of the coarse precipitate forming elements was excessively low, the ratio of the total mass of S contained in the sulfides or oxysulfides of the coarse precipitate forming elements to the total mass of S contained in the non-oriented electrical steel sheet was less than 40%, the iron loss $W15/50_L$ and the average value $W15/50_{L+C}$ were high, and the magnetic flux density $B50_L$ and the average value $B50_{L+C}$ were low. In Sample No. 9, since the total amount of the coarse precipitate forming elements was excessively high, the ratio of the total mass of S contained in the sulfides or oxysulfides of the coarse precipitate forming elements to the total mass of S contained in the non-oriented electrical steel sheet was 40% or greater. However, Ca formed many inclusions such as CaO, the iron loss $W15/50_L$ and the average value $W15/50_{L+C}$ were high, and the magnetic flux density $B50_L$ and the average value $B50_{L+C}$ were low. In Sample No. 10, since the parameter Q was excessively high, the magnetic flux density $B50_L$ and the average value $B50_{L+C}$ were low.

(Second Test)

In a second test, molten steels containing, by mass %, C: 0.0023%, Si: 0.81%, Al: 0.03%, Mn: 0.20%, S: 0.0003%, and Pr: 0.0034% with a remainder consisting of Fe and impurities were cast to produce slabs, and the slabs were hot rolled to obtain steel strips having a thickness of 2.1 mm. During casting, the temperature difference between two surfaces of the cast piece was adjusted to change the columnar grain ratio and the average grain size of the steel strip. Table 4 shows the temperature difference between the two surfaces, the columnar grain ratio, and the average grain size. Next, cold rolling was performed at a rolling reduction of 78.2% to obtain a steel sheet having a thickness of 0.50 mm. Thereafter, continuous final annealing was performed for 30 seconds at 850° C. to obtain a non-oriented electrical steel sheet. Then, intensities of eight crystal orientations of each non-oriented electrical steel sheet were measured, and a parameter R in a thickness middle portion was calculated. Table 4 also shows the results thereof. In Table 4, the underline indicates that the numerical value is out of the range of the invention.

TABLE 4

| Sample No. | Temperature Difference (° C.) | Columnar Grain Ratio (area %) | Average Grain Size of Steel Strip (mm) | Crystal Orientation Intensity I | | | | | | | | Parameter | Remarks |
|---|---|---|---|---|---|---|---|---|---|---|---|---|---|
| | | | | $I_{100}$ | $I_{310}$ | $I_{411}$ | $I_{521}$ | $I_{111}$ | $I_{211}$ | $I_{332}$ | $I_{221}$ | R | |
| 31 | 14 | 45 | 0.18 | 0.76 | 0.55 | 0.49 | 0.92 | 1.48 | 2.02 | 0.51 | 1.15 | 0.53 | Comparative Example |
| 32 | 35 | 71 | 0.21 | 1.11 | 0.73 | 0.47 | 0.89 | 1.33 | 1.51 | 0.48 | 1.01 | 0.74 | Comparative Example |
| 33 | 67 | 86 | 0.19 | 1.77 | 1.29 | 0.88 | 0.78 | 1.19 | 1.45 | 0.25 | 1.18 | 1.16 | Inventive Example |

The magnetic characteristics of each non-oriented electrical steel sheet were measured. Table 5 shows the results thereof. In Table 5, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 5

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 31 | 5.3 | 5.7 | 1.75 | 1.72 | Comparative Example |
| 32 | 5.0 | 5.5 | 1.77 | 1.73 | Comparative Example |
| 33 | 4.4 | 4.6 | 1.82 | 1.80 | Inventive Example |

As shown in Table 5, in Sample No. 33 using a steel strip having an appropriate columnar grain ratio, since the parameter R in the thickness middle portion was within the range of the invention, good magnetic characteristics were obtained.

and the slabs were hot rolled to obtain steel strips having a thickness of 2.4 mm. The remainder consists of Fe and impurities, and in Table 6, the underline indicates that the numerical value is out of the range of the invention. During casting, the temperature difference between two surfaces of the cast piece and the average cooling rate at 700° C. or higher were adjusted to change the columnar grain ratio and the average grain size of the steel strip. The temperature difference between the two surfaces was 48° C. to 60° C. In Sample Nos. 41, and 42, the average cooling rate at 700° C. or higher was 20° C./min, and in Sample Nos. 43 to 45, the average cooling rate at 700° C. or higher was 10° C./min or less. Table 7 shows the columnar grain ratio and the average grain size. Next, cold rolling was performed at a rolling reduction of 79.2% to obtain a steel sheet having a thickness of 0.50 mm. Thereafter, continuous final annealing was performed for 45 seconds at 880° C. to obtain a non-oriented electrical steel sheet. Then, intensities of eight crystal orientations of each non-oriented electrical steel sheet were measured, and a parameter R in a thickness middle portion was calculated. Table 7 also shows the results thereof. In Table 7, the underline indicates that the numerical value is out of the range of the invention.

TABLE 6

| Steel Symbol | Chemical Composition (mass %) C | Si | Al | Mn | S | Cd | Total Content of Coarse Precipitate Forming Elements | Parameter Q |
|---|---|---|---|---|---|---|---|---|
| U | 0.0025 | 1.21 | 0.22 | 0.33 | 0.0011 | 0.0056 | 0.0056 | 1.32 |
| V | 0.0024 | 1.24 | 0.20 | 0.36 | 0.0012 | 0.0060 | 0.0060 | 1.28 |
| W | 0.0022 | 1.22 | 0.18 | 0.32 | 0.0009 | 0.0012 | 0.0012 | 1.26 |
| X | 0.0027 | 1.29 | 0.18 | 0.37 | 0.0010 | 0.0062 | 0.0062 | 1.28 |
| Y | 0.0021 | 1.22 | 0.20 | 0.31 | 0.0008 | 0.0138 | 0.0138 | 1.31 |

TABLE 7

| Sample No. | Steel Symbol | Columnar Grain Ratio (area %) | Average Grain Size of Steel Strip (mm) | Crystal Orientation Intensity I $I_{100}$ | $I_{310}$ | $I_{411}$ | $I_{521}$ | $I_{111}$ | $I_{211}$ | $I_{332}$ | $I_{221}$ | Parameter R | Remarks |
|---|---|---|---|---|---|---|---|---|---|---|---|---|---|
| 41 | U | 88 | 0.05 | 1.23 | 0.58 | 1.02 | 1.32 | 2.41 | 2.37 | 1.02 | 1.76 | 0.55 | Comparative Example |
| 42 | V | 87 | 0.07 | 1.48 | 0.74 | 0.62 | 0.93 | 1.97 | 2.14 | 0.89 | 1.19 | 0.61 | Comparative Example |
| 43 | W | 92 | 0.16 | 1.65 | 0.81 | 0.73 | 0.89 | 2.51 | 1.84 | 0.79 | 1.06 | 0.66 | Comparative Example |
| 44 | X | 90 | 0.15 | 2.11 | 1.19 | 1.23 | 1.04 | 0.88 | 1.15 | 0.67 | 0.96 | 1.52 | Inventive Example |
| 45 | Y | 91 | 0.18 | 1.48 | 0.77 | 0.64 | 1.01 | 2.87 | 2.35 | 0.75 | 1.14 | 0.55 | Comparative Example |

In Sample Nos. 31, and 32 using a steel strip having an excessively low columnar grain ratio, since the parameter R in the thickness middle portion was out of the range of the invention, the iron loss $W15/50_L$ and the average value $W15/50_{L+C}$ were high, and the magnetic flux density $B50_L$ and the average value $B50_{L+C}$ were low.

(Third Test)

In a third test, molten steels each having a chemical composition shown in Table 6 were cast to produce slabs, The magnetic characteristics of each non-oriented electrical steel sheet were measured. Table 8 shows the results thereof. In Table 8, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 8

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 41 | 5.4 | 5.8 | 1.74 | 1.71 | Comparative Example |
| 42 | 5.1 | 5.5 | 1.75 | 1.73 | Comparative Example |
| 43 | 4.8 | 5.3 | 1.77 | 1.74 | Comparative Example |
| 44 | 3.9 | 4.2 | 1.81 | 1.79 | Inventive Example |
| 45 | 5.0 | 5.4 | 1.76 | 1.73 | Comparative Example |

As shown in Table 8, in Sample No. 44 using a steel strip whose chemical composition, columnar grain ratio, and average grain size were appropriate, since the parameter R in the thickness middle portion was within the range of the invention, good magnetic characteristics were obtained.

In Sample Nos. 41, and 42 using a steel strip having an excessively small average grain size, the iron loss $W15/50_L$ and the average value $W15/50_{L+C}$ were high, and the magnetic flux density $B50_L$ and the average value $B50_{L+C}$ were low. In Sample No. 43, since the total amount of the coarse precipitate forming elements was excessively low, the iron loss $W15/50_L$ and the average value $W15/50_{L+C}$ were high, and the magnetic flux density $B50_L$ and the average value $B50_{L+C}$ were low. In Sample No. 45, since the total amount of the coarse precipitate forming elements was excessively high, the iron loss $W15/50_L$ and the average value $W15/50_{L+C}$ were high, and the magnetic flux density $B50_L$ and the average value $B50_{L+C}$ were low.

(Fourth Test)

In a fourth test, molten steels each having a chemical composition shown in Table 9 were cast to produce slabs, and the slabs were hot rolled to obtain steel strips having a thickness shown in Table 10. In Table 9, the blank indicates that the amount of the corresponding element is less than the detection limit, and the remainder consists of Fe and impurities. During casting, the temperature difference between two surfaces of the cast piece was adjusted to change the columnar grain ratio and the average grain size of the steel strip. The temperature difference between the two surfaces was 51° C. to 68° C. Table 10 also shows the columnar grain ratio and the average grain size. Next, cold rolling was performed at a rolling reduction shown in Table 10 to obtain a steel sheet having a thickness of 0.50 mm. After that, continuous final annealing was performed for 40 seconds at 830° C. to obtain a non-oriented electrical steel sheet. Then, intensities of eight crystal orientations of each non-oriented electrical steel sheet were measured, and a parameter R in a thickness middle portion was calculated. Table 10 also shows the results thereof. In Table 10, the underline indicates that the numerical value is out of the range of the invention.

TABLE 9

| Steel Symbol | Chemical Composition (mass %) | | | | | | | | | |
|---|---|---|---|---|---|---|---|---|---|---|
| | C | Si | Al | Mn | S | Ba | Sn | Cu | Total Content of Coarse Precipitate Forming Elements | Parameter Q |
| Z | 0.0017 | 0.53 | 0.32 | 0.49 | 0.0022 | 0.0073 | | | 0.0073 | 0.68 |
| AA | 0.0018 | 0.54 | 0.29 | 0.51 | 0.0019 | 0.0071 | | | 0.0071 | 0.61 |
| BB | 0.0014 | 0.51 | 0.28 | 0.50 | 0.0018 | 0.0077 | 0.09 | | 0.0077 | 0.57 |
| CC | 0.0016 | 0.51 | 0.33 | 0.47 | 0.0022 | 0.0074 | | 0.48 | 0.0074 | 0.70 |
| DD | 0.0012 | 0.52 | 0.25 | 0.45 | 0.0020 | 0.0070 | 0.21 | 0.32 | 0.0070 | 0.57 |
| EE | 0.0013 | 0.56 | 0.30 | 0.56 | 0.0021 | 0.0079 | | | 0.0079 | 0.60 |

TABLE 10

| Sample No. | Steel Symbol | Thickness of Steel Strip (mm) | Columnar Grain Ratio (area %) | Average Grain Size of Steel Strip (mm) | Rolling Reduction (%) | Crystal Orientation Intensity I | | | | | | | | Parameter R | Remarks |
|---|---|---|---|---|---|---|---|---|---|---|---|---|---|---|---|
| | | | | | | $I_{100}$ | $I_{310}$ | $I_{411}$ | $I_{521}$ | $I_{111}$ | $I_{211}$ | $I_{332}$ | $I_{221}$ | | |
| 51 | Z | 0.95 | 92 | 0.22 | 47.4 | 1.33 | 1.02 | 0.97 | 0.65 | 1.01 | 1.17 | 0.29 | 1.13 | 1.10 | Inventive Example |
| 52 | AA | 1.55 | 97 | 0.21 | 67.7 | 1.54 | 1.20 | 1.38 | 0.77 | 0.95 | 1.06 | 0.46 | 0.89 | 1.46 | Inventive Example |
| 53 | BB | 2.03 | 88 | 0.24 | 75.4 | 1.66 | 1.19 | 1.51 | 0.83 | 0.77 | 1.01 | 0.52 | 0.78 | 1.69 | Inventive Example |
| 54 | CC | 2.55 | 90 | 0.23 | 80.4 | 1.59 | 1.24 | 1.36 | 0.94 | 0.83 | 1.15 | 0.42 | 1.05 | 1.49 | Inventive Example |
| 55 | DD | 3.76 | 100 | 0.20 | 86.7 | 1.83 | 1.15 | 1.64 | 0.78 | 0.69 | 0.88 | 0.39 | 0.92 | 1.88 | Inventive Example |
| 56 | EE | 5.62 | 86 | 0.21 | 91.1 | 1.44 | 0.87 | 1.23 | 0.69 | 1.84 | 2.05 | 0.76 | 1.18 | 0.73 | Comparative Example |

The magnetic characteristics of each non-oriented electrical steel sheet were measured. Table 11 shows the results thereof. In Table 11, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 11

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 51 | 4.4 | 4.6 | 1.79 | 1.76 | Inventive Example |
| 52 | 4.2 | 4.4 | 1.80 | 1.77 | Inventive Example |
| 53 | 3.9 | 4.2 | 1.83 | 1.81 | Inventive Example |
| 54 | 4.0 | 4.3 | 1.82 | 1.79 | Inventive Example |
| 55 | 3.8 | 4.0 | 1.84 | 1.82 | Inventive Example |
| 56 | 4.8 | 5.2 | 1.77 | 1.73 | Comparative Example |

As shown in Table 11, in Sample Nos. 51 to 55 using a steel strip whose chemical composition, columnar grain ratio, and average grain size were appropriate, and cold rolled at an appropriate reduction, since the parameter R in the thickness middle portion was within the range of the invention, good magnetic characteristics were obtained. In Sample Nos. 53, and 54 containing an appropriate amount of Sn or Cu, particularly excellent results were obtained in the iron loss $W15/50_L$, average value $W15/50_{L+C}$, magnetic flux density $B50_L$, and average value $B50_{L+C}$. In Sample No. 55 containing an appropriate amount of Sn and Cu, more excellent results were obtained in the iron loss $W15/50_L$, average value $W15/50_{L+C}$, magnetic flux density $B50_L$, and average value $B50_{L+C}$.

In Sample No. 56 in which the rolling reduction of cold rolling was excessively high, the iron loss $W15/50_L$ and the average value $W15/50_{L+C}$ were high, and the magnetic flux density $B50_L$ and the average value $B50_{L+C}$ were low.

(Fifth Test)

In a fifth test, molten steels containing, by mass %, C: 0.0014%, Si: 0.34%, Al: 0.48%, Mn: 1.42%, S: 0.0017%, and Sr: 0.0038% with a remainder consisting of Fe and impurities were cast to produce slabs, and the slabs were hot rolled to obtain steel strips having a thickness of 2.3 mm. During casting, the temperature difference between two surfaces of the cast piece was adjusted to 59° C. such that the columnar grain ratio of the steel strip was 90% and the average grain size was 0.17 mm. Next, cold rolling was performed at a rolling reduction of 78.3% to obtain a steel sheet having a thickness of 0.50 mm. Thereafter, continuous final annealing was performed for 20 seconds at 920° C. to obtain a non-oriented electrical steel sheet. In final annealing, the sheet traveling tension and the cooling rate from 950° C. to 700° C. were changed. Table 12 shows the sheet traveling tension and the cooling rate. The crystal orientation intensity of each non-oriented electrical steel sheet was measured, and a parameter R in a thickness middle portion was calculated. Table 12 also shows the results thereof.

TABLE 12

| Sample No. | Sheet Traveling Tension (MPa) | Cooling Rate (° C./sec) | Elastic Strain Anisotropy (%) | Crystal Orientation Intensity I | | | | | | | | Parameter | Remarks |
|---|---|---|---|---|---|---|---|---|---|---|---|---|---|
| | | | | $I_{100}$ | $I_{310}$ | $I_{411}$ | $I_{521}$ | $I_{111}$ | $I_{211}$ | $I_{332}$ | $I_{221}$ | R | |
| 61 | 4.5 | 2.3 | 1.18 | 1.39 | 0.96 | 1.35 | 1.00 | 1.55 | 0.64 | 1.18 | 1.69 | 0.93 | Inventive Example |
| 62 | 2.6 | 2.6 | 1.09 | 1.56 | 1.04 | 1.55 | 1.21 | 1.38 | 0.71 | 1.17 | 1.38 | 1.16 | Inventive Example |
| 63 | 1.8 | 2.4 | 1.07 | 1.87 | 1.11 | 1.61 | 1.13 | 1.30 | 0.59 | 1.21 | 1.41 | 1.27 | Inventive Example |
| 64 | 1.6 | 0.7 | 1.03 | 2.38 | 1.18 | 2.16 | 1.22 | 1.21 | 0.66 | 1.09 | 1.36 | 1.61 | Inventive Example |

The magnetic characteristics of each non-oriented electrical steel sheet were measured. Table 13 shows the results thereof.

TABLE 13

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 61 | 4.2 | 4.4 | 1.82 | 1.80 | Inventive Example |
| 62 | 3.9 | 4.1 | 1.83 | 1.81 | Inventive Example |
| 63 | 3.8 | 4.1 | 1.83 | 1.81 | Inventive Example |
| 64 | 3.7 | 3.9 | 1.84 | 1.83 | Inventive Example |

As shown in Table 13, in Sample Nos. 61 to 64, the chemical composition was within the range of the invention, and the parameter R in the thickness middle portion was within the range of the invention. Accordingly, good magnetic characteristics were obtained. In Sample Nos. 62, and 63 in which the sheet traveling tension was 3 MPa or less, the elastic strain anisotropy was low, and particularly excellent results were obtained in the iron loss $W15/50_L$, average value $W15/50_{L+C}$, magnetic flux density $B50_L$, and average value $B50_{L+C}$. In Sample No. 64 in which the cooling rate from 920° C. to 700° C. was PC/sec or less, the elastic strain anisotropy was further reduced, and more excellent results were obtained in the iron loss $W15/50_L$, average value $W15/50_{L+C}$, magnetic flux density $B50_L$, and average value $B50_{L+C}$. In the measurement of the elastic strain anisotropy, a sample having a quadrangular planar shape in which each side had a length of 55 mm, two sides were parallel to the rolling direction, and two sides were parallel to the direction perpendicular to the rolling direction (sheet width direction) was cut out from each non-oriented electrical steel sheet, and the length of each side after deformation under the influence of elastic strain was measured. Then, it was determined how much the length in the direction perpendicular to the rolling direction was greater than the length in the rolling direction.

(Sixth Test)

In a sixth test, molten steels each having a chemical composition shown in Table 14 were rapidly solidified by a twin roll method to obtain steel strips. In Table 14, the blank indicates that the amount of the corresponding element is less than the detection limit, and the remainder consists of Fe and impurities. In Table 14, the underline indicates that the numerical value is out of the range of the invention. Next, the steel strips were cold rolled and subjected to final annealing to produce various non-oriented electrical steel sheets having a thickness of 0.50 mm. Then, intensities of eight crystal orientations of each non-oriented electrical steel sheet were measured, and a parameter R in a thickness middle portion was calculated. Table 15 shows the results thereof. In Table 15, the underline indicates that the numerical value is out of the range of the invention.

TABLE 14

| Steel | Chemical Composition (mass %) | | | | | | | | |
|---|---|---|---|---|---|---|---|---|---|
| Symbol | C | Si | Al | Mn | S | Mg | Ca | Sr | Ba |
| A | 0.0014 | 1.02 | 0.03 | 0.20 | 0.0022 | | | 0.0020 | |
| B | 0.0013 | 1.05 | 0.02 | 0.18 | 0.0020 | | | 0.0034 | |
| C | 0.0021 | 1.04 | 0.03 | 0.17 | 0.0019 | | | | 0.0043 |
| D | 0.0025 | 1.00 | 0.03 | 0.18 | 0.0023 | | | | 0.0039 |
| E' | 0.0018 | 1.03 | 0.04 | 0.22 | 0.0024 | | | | |
| F | 0.0019 | 0.98 | 0.04 | 0.17 | 0.0016 | | | | |
| G | 0.0011 | 1.07 | 0.03 | 0.26 | 0.0035 | | 0.0019 | | |
| H | 0.0021 | 1.02 | 0.03 | 0.21 | 0.0020 | | 0.0012 | | |
| I | 0.0022 | 1.01 | 0.03 | 0.19 | 0.0018 | | 0.0147 | | |
| J | 0.0020 | 2.46 | 0.02 | 0.22 | 0.0027 | 0.0027 | | | |
| K | 0.0018 | 1.05 | 0.03 | 0.24 | 0.0022 | 0.0021 | | | |
| L | 0.0016 | 1.09 | 0.03 | 0.21 | 0.0019 | | 0.0041 | | |
| M | 0.0016 | 0.98 | 0.04 | 0.22 | 0.0021 | | | 0.0028 | |
| N | 0.0020 | 1.00 | 0.03 | 0.22 | 0.0018 | | | | 0.0035 |
| O' | 0.0019 | 1.02 | 0.02 | 0.21 | 0.0017 | | | | |
| P | 0.0017 | 1.02 | 0.02 | 0.24 | 0.0024 | | | | |
| Q | 0.0021 | 1.01 | 0.04 | 0.21 | 0.0022 | | | | |
| R | 0.0024 | 1.07 | 0.02 | 0.22 | 0.0015 | | | | |
| S | 0.0022 | 1.05 | 0.02 | 0.24 | 0.0018 | | | | |
| T | 0.0018 | 1.03 | 0.003 | 0.21 | 0.0017 | | | | |

| Steel | Chemical Composition (mass %) | | | | | | Total Content of Coarse Precipitate Forming | Parameter |
|---|---|---|---|---|---|---|---|---|
| Symbol | La | Ce | Zn | Cd | Sn | Cu | Elements | Q |
| A | | | | | | | 0.0020 | 0.88 |
| B | | | | | | | 0.0034 | 0.91 |
| C | | | | | | | 0.0043 | 0.93 |
| D | | | | | | | 0.0039 | 0.88 |
| E' | 0.0078 | | | | | | 0.0078 | 0.89 |
| F | | | 0.0043 | | | | 0.0043 | 0.89 |
| G | | | | | | | 0.0019 | 0.87 |
| H | | | | | | | 0.0012 | 0.87 |
| I | | | | | | | 0.0147 | 0.88 |
| J | | | | | | | 0.0027 | 2.28 |
| K | | | | | | | 0.0021 | 0.87 |
| L | | | | | | | 0.0041 | 0.94 |
| M | | | | | | | 0.0028 | 0.84 |
| N | | | | | | | 0.0035 | 0.84 |
| O' | 0.0063 | | | | | | 0.0063 | 0.85 |
| P | | | 0.0054 | | | | 0.0054 | 0.82 |
| Q | | | | 0.0038 | | | 0.0038 | 0.88 |
| R | | | | 0.0042 | 0.14 | | 0.0042 | 0.89 |
| S | | | | 0.0039 | | 0.32 | 0.0039 | 0.85 |
| T | 0.0035 | 0.0044 | | | | | 0.0079 | 0.83 |

TABLE 15

| Sample | Steel | Crystal Orientation Intensity I | | | | | | | | Parameter | |
|---|---|---|---|---|---|---|---|---|---|---|---|
| No. | Symbol | $I_{100}$ | $I_{310}$ | $I_{411}$ | $I_{521}$ | $I_{111}$ | $I_{211}$ | $I_{332}$ | $I_{221}$ | R | Remarks |
| 101 | A | 1.03 | 0.88 | 0.68 | 0.43 | 2.01 | 2.33 | 0.48 | 1.29 | 0.49 | Comparative Example |
| 102 | B | 1.12 | 1.05 | 0.79 | 0.61 | 1.63 | 1.94 | 0.39 | 1.14 | 0.70 | Comparative Example |
| 103 | C | 0.85 | 0.77 | 0.47 | 0.31 | 2.25 | 1.56 | 0.64 | 1.78 | 0.39 | Comparative Example |
| 104 | D | 1.06 | 0.82 | 0.62 | 0.57 | 2.01 | 1.32 | 0.53 | 1.44 | 0.58 | Comparative Example |
| 105 | E' | 1.11 | 1.23 | 1.08 | 0.52 | 2.21 | 1.65 | 0.99 | 1.22 | 0.65 | Comparative Example |
| 106 | F | 0.98 | 0.89 | 1.05 | 0.29 | 1.99 | 1.78 | 0.67 | 1.02 | 0.59 | Comparative Example |
| 107 | G | 1.14 | 1.01 | 0.39 | 0.44 | 1.78 | 1.42 | 0.95 | 1.07 | 0.57 | Comparative Example |

TABLE 15-continued

| Sample No. | Steel Symbol | Crystal Orientation Intensity I $I_{100}$ | $I_{310}$ | $I_{411}$ | $I_{521}$ | $I_{111}$ | $I_{211}$ | $I_{332}$ | $I_{221}$ | Parameter R | Remarks |
|---|---|---|---|---|---|---|---|---|---|---|---|
| 108 | H | 1.27 | 0.92 | 0.66 | 0.92 | 1.38 | 1.58 | 0.82 | 1.31 | 0.74 | Comparative Example |
| 109 | I | 1.19 | 0.88 | 0.45 | 0.70 | 1.58 | 1.49 | 0.54 | 1.14 | 0.68 | Comparative Example |
| 110 | J | 1.17 | 1.04 | 0.69 | 0.66 | 1.49 | 1.35 | 0.68 | 1.33 | 0.73 | Comparative Example |
| 111 | K | 1.59 | 0.92 | 0.83 | 0.78 | 0.97 | 1.29 | 0.48 | 0.99 | 1.10 | Inventive Example |
| 112 | L | 1.62 | 1.06 | 1.01 | 0.66 | 0.88 | 1.36 | 0.37 | 1.22 | 1.14 | Inventive Example |
| 113 | M | 1.44 | 1.22 | 0.89 | 0.71 | 1.02 | 1.16 | 0.29 | 1.08 | 1.20 | Inventive Example |
| 114 | N | 1.92 | 0.69 | 0.95 | 0.83 | 1.35 | 1.62 | 0.44 | 1.29 | 0.93 | Inventive Example |
| 115 | O' | 1.55 | 0.88 | 1.21 | 0.87 | 0.87 | 1.00 | 0.31 | 1.45 | 1.24 | Inventive Example |
| 116 | P | 2.04 | 0.77 | 1.33 | 0.53 | 1.38 | 1.77 | 0.69 | 1.85 | 0.82 | Inventive Example |
| 117 | Q | 1.88 | 1.31 | 1.04 | 0.75 | 1.09 | 0.98 | 0.27 | 1.23 | 1.39 | Inventive Example |
| 118 | R | 2.63 | 1.05 | 1.93 | 0.43 | 0.66 | 0.68 | 0.66 | 1.15 | 1.92 | Inventive Example |
| 119 | S | 2.47 | 0.99 | 1.68 | 0.55 | 0.78 | 0.82 | 0.62 | 1.12 | 1.70 | Inventive Example |
| 120 | T | 1.98 | 1.11 | 1.52 | 0.65 | 0.73 | 0.78 | 0.59 | 1.08 | 1.65 | Inventive Example |

The magnetic characteristics of each non-oriented electrical steel sheet were measured. Table 16 shows the results thereof. In Table 16, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 16

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 101 | 5.3 | 5.7 | 1.73 | 1.71 | Comparative Example |
| 102 | 4.9 | 5.3 | 1.76 | 1.73 | Comparative Example |
| 103 | 5.4 | 5.7 | 1.73 | 1.70 | Comparative Example |
| 104 | 5.3 | 5.6 | 1.74 | 1.72 | Comparative Example |
| 105 | 5.1 | 5.4 | 1.75 | 1.71 | Comparative Example |
| 106 | 5.2 | 5.5 | 1.74 | 1.70 | Comparative Example |
| 107 | 5.2 | 5.6 | 1.74 | 1.71 | Comparative Example |
| 108 | 5.2 | 5.5 | 1.77 | 1.73 | Comparative Example |
| 109 | 5.0 | 5.3 | 1.75 | 1.72 | Comparative Example |
| 110 | 3.5 | 3.8 | 1.73 | 1.69 | Comparative Example |
| 111 | 4.2 | 4.5 | 1.81 | 1.78 | Inventive Example |
| 112 | 4.2 | 4.4 | 1.81 | 1.78 | Inventive Example |
| 113 | 4.1 | 4.4 | 1.82 | 1.79 | Inventive Example |
| 114 | 4.4 | 4.7 | 1.79 | 1.77 | Inventive Example |
| 115 | 4.1 | 4.3 | 1.82 | 1.80 | Inventive Example |
| 116 | 4.4 | 4.8 | 1.79 | 1.76 | Inventive Example |
| 117 | 4.1 | 4.3 | 1.81 | 1.79 | Inventive Example |
| 118 | 3.8 | 4.1 | 1.83 | 1.81 | Inventive Example |
| 119 | 4.0 | 4.2 | 1.83 | 1.80 | Inventive Example |
| 120 | 3.9 | 4.1 | 1.82 | 1.80 | Inventive Example |

As shown in Table 16, in Sample Nos. 111 to 120, the chemical composition was within the range of the invention, and the parameter R in the thickness middle portion was within the range of the invention. Accordingly, good magnetic characteristics were obtained.

In Sample Nos. 101 to 106, since the parameter R in the thickness middle portion was excessively low, the iron loss $W15/50_L$ and the average value $W15/50_{L+C}$ were high, and the magnetic flux density $B50_L$ and the average value $B50_{L+C}$ were low. In Sample No. 107, since the S content was excessively high, the iron loss $W15/50_L$ and the average value $W15/50_{L+C}$ were high, and the magnetic flux density $B50_L$ and the average value $B50_{L+C}$ were low. In Sample No. 108, since the total amount of the coarse precipitate forming elements was excessively low, the iron loss $W15/50_L$ and the average value $W15/50_{L+C}$ were high, and the magnetic flux density $B50_L$ and the average value $B50_{L+C}$ were low. In Sample No. 109, since the total amount of the coarse precipitate forming elements was excessively high, the iron loss $W15/50_L$ and the average value $W15/50_{L+C}$ were high, and the magnetic flux density $B50_L$ and the average value $B50_{L+C}$ were low. In Sample No. 110, since the parameter Q was excessively high, the magnetic flux density $B50_L$ and the average value $B50_{L+C}$ were low.

(Seventh Test)

In a seventh test, molten steels containing, by mass %, C: 0.0023%, Si: 0.81%, Al: 0.03%, Mn: 0.20%, S: 0.0003%, and Nd: 0.0034% with a remainder consisting of Fe and impurities were rapidly solidified by a twin roll method to obtain steel strips having a thickness of 2.1 mm. In this case, the injection temperature was adjusted to change the columnar grain ratio and the average grain size of the steel strip. Table 17 shows the difference between the injection temperature and the solidification temperature, the columnar grain ratio, and the average grain size. Next, cold rolling was performed at a rolling reduction of 78.2% to obtain a steel sheet having a thickness of 0.50 mm. Thereafter, continuous final annealing was performed for 30 seconds at 850° C. to obtain a non-oriented electrical steel sheet. Then, intensities of eight crystal orientations of each non-oriented electrical steel sheet were measured, and a parameter R in a thickness middle portion was calculated. Table 17 also shows the results thereof. In Table 17, the underline indicates that the numerical value is out of the range of the invention.

TABLE 17

| Sample No. | Temperature Difference (° C.) | Columnar Grain Ratio (area %) | Average Grain Size of Steel Strip (mm) | Crystal Orientation Intensity I | | | | | | | | Parameter R | Remarks |
|---|---|---|---|---|---|---|---|---|---|---|---|---|---|
| | | | | $I_{100}$ | $I_{310}$ | $I_{411}$ | $I_{521}$ | $I_{111}$ | $I_{211}$ | $I_{332}$ | $I_{221}$ | | |
| 131 | 13 | 45 | 0.18 | 0.76 | 0.55 | 0.49 | 0.92 | 1.48 | 2.02 | 0.51 | 1.15 | 0.53 | Comparative Example |
| 132 | 21 | 71 | 0.21 | 1.11 | 0.73 | 0.47 | 0.89 | 1.33 | 1.51 | 0.48 | 1.01 | 0.74 | Comparative Example |
| 133 | 28 | 86 | 0.19 | 1.77 | 1.29 | 0.88 | 0.78 | 1.19 | 1.45 | 0.25 | 1.18 | 1.16 | Inventive Example |

The magnetic characteristics of each non-oriented electrical steel sheet were measured. Table 18 shows the results thereof. In Table 18, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 18

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 131 | 5.3 | 5.7 | 1.75 | 1.72 | Comparative Example |
| 132 | 5.0 | 5.5 | 1.77 | 1.73 | Comparative Example |
| 133 | 4.4 | 4.6 | 1.82 | 1.80 | Inventive Example |

As shown in Table 18, in Sample No. 133 using a steel strip having an appropriate columnar grain ratio, since the parameter R in the thickness middle portion was within the range of the invention, good magnetic characteristics were obtained.

In Sample Nos. 131, and 132 using a steel strip having an excessively low columnar grain ratio, the iron loss $W15/50_L$ and the average value $W15/50_{L+C}$ were high, and the magnetic flux density $B50_L$ and the average value $B50_{L+C}$ were low.

(Eighth Test)

In an eighth test, molten steels each having a chemical composition shown in Table 19 were rapidly solidified by a twin roll method to obtain steel strips having a thickness of 2.4 mm. The remainder consists of Fe and impurities, and in Table 19, the underline indicates that the numerical value is out of the range of the invention. In this case, the injection temperature and the average cooling rate from completion of the solidification of the molten steel to coiling of the steel strip were adjusted to change the columnar grain ratio and the average grain size of the steel strip. The injection temperature of Examples 143 to 145 was 29° C. to 35° C. higher than the solidification temperature, and the average cooling rate from completion of the solidification of the molten steel to coiling of the steel strip was 1,500 to 2,000° C./min. The injection temperature of Examples 141, and 142 was 20° C. to 24° C. higher than the solidification temperature, and the average cooling rate from completion of the solidification of the molten steel to coiling of the steel strip was greater than 3,000° C./imin. Table 20 shows the columnar grain ratio and the average grain size. Next, cold rolling was performed at a rolling reduction of 79.2% to obtain a steel sheet having a thickness of 0.50 mm. Thereafter, continuous final annealing was performed for 45 seconds at 880° C. to obtain a non-oriented electrical steel sheet. Then, intensities of eight crystal orientations of each non-oriented electrical steel sheet were measured, and a parameter R in a thickness middle portion was calculated. Table 20 also shows the results thereof. In Table 20, the underline indicates that the numerical value is out of the range of the invention.

TABLE 19

| Steel Symbol | Chemical Composition (mass %) C | Si | Al | Mn | S | Cd | Total Content of Coarse Precipitate Forming Elements | Parameter Q |
|---|---|---|---|---|---|---|---|---|
| U | 0.0025 | 1.21 | 0.22 | 0.33 | 0.0011 | 0.0056 | 0.0056 | 1.32 |
| V | 0.0024 | 1.24 | 0.20 | 0.36 | 0.0012 | 0.0060 | 0.0060 | 1.28 |
| W | 0.0022 | 1.22 | 0.18 | 0.32 | 0.0009 | 0.0012 | 0.0012 | 1.26 |
| X | 0.0027 | 1.29 | 0.18 | 0.37 | 0.0010 | 0.0062 | 0.0062 | 1.28 |
| Y | 0.0021 | 1.22 | 0.20 | 0.31 | 0.0008 | 0.0138 | 0.0138 | 1.31 |

TABLE 20

| Sample No. | Steel Symbol | Columnar Grain Ratio (area %) | Average Grain Size of Steel Strip (mm) | Crystal Orientation Intensity I | | | | | | | | Parameter R | Remarks |
|---|---|---|---|---|---|---|---|---|---|---|---|---|---|
| | | | | $I_{100}$ | $I_{310}$ | $I_{411}$ | $I_{521}$ | $I_{111}$ | $I_{211}$ | $I_{332}$ | $I_{221}$ | | |
| 141 | U | 88 | 0.05 | 1.23 | 0.58 | 1.02 | 1.32 | 2.41 | 2.37 | 1.02 | 1.76 | 0.55 | Comparative Example |
| 142 | V | 87 | 0.07 | 1.48 | 0.74 | 0.62 | 0.93 | 1.97 | 2.14 | 0.89 | 1.19 | 0.61 | Comparative Example |
| 143 | W | 92 | 0.16 | 1.65 | 0.81 | 0.73 | 0.89 | 2.51 | 1.84 | 0.79 | 1.06 | 0.66 | Comparative Example |
| 144 | X | 90 | 0.15 | 2.11 | 1.19 | 1.23 | 1.04 | 0.88 | 1.15 | 0.67 | 0.96 | 1.52 | Inventive Example |
| 145 | Y | 91 | 0.18 | 1.48 | 0.77 | 0.64 | 1.01 | 2.87 | 2.35 | 0.75 | 1.14 | 0.55 | Comparative Example |

The magnetic characteristics of each non-oriented electrical steel sheet were measured. Table 21 shows the results thereof. In Table 21, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 21

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 141 | 5.4 | 5.8 | 1.74 | 1.71 | Comparative Example |
| 142 | 5.1 | 5.5 | 1.75 | 1.73 | Comparative Example |
| 143 | 4.8 | 5.3 | 1.77 | 1.74 | Comparative Example |
| 144 | 3.9 | 4.2 | 1.81 | 1.79 | Inventive Example |
| 145 | 5.0 | 5.4 | 1.76 | 1.73 | Comparative Example |

As shown in Table 21, in Sample No. 144 using a steel strip whose chemical composition, columnar grain ratio, and average grain size were appropriate, since the parameter R in the thickness middle portion was within the range of the invention, good magnetic characteristics were obtained.

In Sample Nos. 141, and 142 using a steel strip having an excessively small average grain size, the iron loss $W15/50_L$ and the average value $W15/50_{L+C}$ were high, and the magnetic flux density $B50_L$ and the average value $B50_{L+C}$ were low. In Sample No. 143, since the total amount of the coarse precipitate forming elements was excessively low, the iron loss $W15/50_L$ and the average value $W15/50_{L+C}$ were high, and the magnetic flux density $B50_L$ and the average value $B50_{L+C}$ were low. In Sample No. 145, since the total amount of the coarse precipitate forming elements was excessively high, the iron loss $W15/50_L$ and the average value $W15/50_{L+C}$ were high, and the magnetic flux density $B50_L$ and the average value $B50_{L+C}$ were low.

(Ninth Test)

In a ninth test, molten steels each having a chemical composition shown in Table 22 were rapidly solidified by a twin roll method to obtain steel strips having a thickness shown in Table 23. In Table 22, the blank indicates that the amount of the corresponding element is less than the detection limit, and the remainder consists of Fe and impurities. In this case, the injection temperature was adjusted to change the columnar grain ratio and the average grain size of the steel strip. The injection temperature was 28° C. to 37° C. higher than the solidification temperature. Table 23 also shows the columnar grain ratio and the average grain size. Next, cold rolling was performed at a rolling reduction shown in Table 23 to obtain a steel sheet having a thickness of 0.20 mm. After that, continuous final annealing was performed for 40 seconds at 830° C. to obtain a non-oriented electrical steel sheet. Then, intensities of eight crystal orientations of each non-oriented electrical steel sheet were measured, and a parameter R in a thickness middle portion was calculated. Table 23 also shows the results thereof. In Table 23, the underline indicates that the numerical value is out of the range of the invention.

TABLE 22

| Steel Symbol | Chemical Composition (mass %) | | | | | | | | | |
|---|---|---|---|---|---|---|---|---|---|---|
| | C | Si | Al | Mn | S | Ba | Sn | Cu | Total Content of Coarse Precipitate Forming Elements | Parameter Q |
| Z | 0.0017 | 0.53 | 0.32 | 0.49 | 0.0022 | 0.0073 | | | 0.0073 | 0.68 |
| AA | 0.0018 | 0.54 | 0.29 | 0.51 | 0.0019 | 0.0071 | | | 0.0071 | 0.61 |
| BB | 0.0014 | 0.51 | 0.28 | 0.50 | 0.0018 | 0.0077 | 0.09 | | 0.0077 | 0.57 |
| CC | 0.0016 | 0.51 | 0.33 | 0.47 | 0.0022 | 0.0074 | | 0.48 | 0.0074 | 0.70 |
| EE | 0.0013 | 0.56 | 0.30 | 0.56 | 0.0021 | 0.0079 | | | 0.0079 | 0.60 |

TABLE 23

| Sample No. | Steel Symbol | Thickness of Steel Strip (mm) | Columnar Grain Ratio (area %) | Average Grain Size of Steel Strip (mm) | Rolling Reduction (%) | Crystal Orientation Intensity I | | | | | | | | Parameter R | Remarks |
|---|---|---|---|---|---|---|---|---|---|---|---|---|---|---|---|
| | | | | | | $I_{100}$ | $I_{310}$ | $I_{411}$ | $I_{521}$ | $I_{111}$ | $I_{211}$ | $I_{332}$ | $I_{221}$ | | |
| 151 | Z | 0.38 | 92 | 0.22 | 47.4 | 1.33 | 1.02 | 0.97 | 0.65 | 1.01 | 1.17 | 0.29 | 1.13 | 1.10 | Inventive Example |
| 152 | AA | 0.62 | 97 | 0.21 | 67.7 | 1.54 | 1.20 | 1.38 | 0.77 | 0.95 | 1.06 | 0.46 | 0.89 | 1.46 | Inventive Example |
| 153 | BB | 0.81 | 88 | 0.24 | 75.4 | 1.66 | 1.19 | 1.51 | 0.83 | 0.77 | 1.01 | 0.52 | 0.78 | 1.69 | Inventive Example |
| 154 | CC | 1.02 | 90 | 0.23 | 80.4 | 1.59 | 1.24 | 1.36 | 0.94 | 0.83 | 1.15 | 0.42 | 1.05 | 1.49 | Inventive Example |
| 155 | EE | 2.24 | 86 | 0.21 | 91.1 | 1.44 | 0.87 | 1.23 | 0.69 | 1.84 | 2.05 | 0.76 | 1.18 | 0.73 | Comparative Example |

The magnetic characteristics of each non-oriented electrical steel sheet were measured. Table 24 shows the results thereof. In Table 24, the underline indicates that the numerical value is not within a desired range. That is, the underline in the column of magnetic flux density $B50_L$ indicates that the magnetic flux density is less than 1.79 T, the underline in the column of average value $B50_{L+C}$ indicates that the average value is less than 1.75 T, the underline in the column of iron loss $W15/50_L$ indicates the iron loss is greater than 4.5 W/kg, and the underline in the column of average value $W15/50_{L+C}$ indicates that the average value is greater than 5.0 W/kg.

TABLE 24

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 151 | 4.4 | 4.6 | 1.79 | 1.76 | Inventive Example |
| 152 | 4.2 | 4.4 | 1.80 | 1.77 | Inventive Example |
| 153 | 3.9 | 4.2 | 1.83 | 1.81 | Inventive Example |
| 154 | 4.0 | 4.3 | 1.82 | 1.79 | Inventive Example |
| 155 | 4.8 | 5.2 | 1.77 | 1.73 | Comparative Example |

As shown in Table 24, in Sample Nos. 151 to 154 using a steel strip whose chemical composition, columnar grain ratio, and average grain size were appropriate, and cold rolled at an appropriate reduction, since the parameter R in the thickness middle portion was within the range of the invention, good magnetic characteristics were obtained. In Sample Nos. 153, and 154 containing an appropriate amount of Sn or Cu, particularly excellent results were obtained in the iron loss $W15/50_L$, average value $W15/50_{L+C}$, magnetic flux density $B50_L$, and average value $B50_{L+C}$.

In Sample No. 155 in which the rolling reduction of cold rolling was excessively high, the iron loss $W15/50_L$ and the average value $W15/50_{L+C}$ were high, and the magnetic flux density $B50_L$ and the average value $B50_{L+C}$ were low.

(Tenth Test)

In a tenth test, molten steels containing, by mass %, C: 0.0014%, Si: 0.34%, Al: 0.48%, Mn: 1.42%, S: 0.0017%, and Sr: 0.0038% with a remainder consisting of Fe and impurities were rapidly solidified by a twin roll method to obtain steel strips having a thickness of 2.3 mm. In this case, the injection temperature was adjusted to be 32° C. higher than the solidification temperature such that the columnar grain ratio of the steel strip was 90% and the average grain size was 0.17 mm. Next, cold rolling was performed at a rolling reduction of 78.3% to obtain a steel sheet having a thickness of 0.50 mm. Thereafter, continuous final annealing was performed for 20 seconds at 920° C. to obtain a non-oriented electrical steel sheet. In final annealing, the sheet traveling tension and the cooling rate from 920° C. to 700° C. were changed. Table 25 shows the sheet traveling tension and the cooling rate. The crystal orientation intensity of each non-oriented electrical steel sheet was measured, and a parameter R in a thickness middle portion was calculated. Table 25 also shows the results thereof.

TABLE 25

| Sample No. | Sheet Traveling Tension (MPa) | Cooling Rate (° C./sec) | Elastic Strain Anisotropy (%) | Crystal Orientation Intensity I | | | | | | | | Parameter R | Remarks |
|---|---|---|---|---|---|---|---|---|---|---|---|---|---|
| | | | | $I_{100}$ | $I_{310}$ | $I_{411}$ | $I_{521}$ | $I_{111}$ | $I_{211}$ | $I_{332}$ | $I_{221}$ | | |
| 161 | 4.5 | 2.3 | 1.18 | 1.39 | 0.96 | 1.35 | 1.00 | 1.55 | 0.64 | 1.18 | 1.69 | 0.93 | Inventive Example |
| 162 | 2.6 | 2.6 | 1.09 | 1.56 | 1.04 | 1.55 | 1.21 | 1.38 | 0.71 | 1.17 | 1.38 | 1.16 | Inventive Example |
| 163 | 1.8 | 2.4 | 1.07 | 1.87 | 1.11 | 1.61 | 1.13 | 1.30 | 0.59 | 1.21 | 1.41 | 1.27 | Inventive Example |
| 164 | 1.6 | 0.7 | 1.03 | 2.38 | 1.18 | 2.16 | 1.22 | 1.21 | 0.66 | 1.09 | 1.36 | 1.61 | Inventive Example |

The magnetic characteristics of each non-oriented electrical steel sheet were measured. Table 26 shows the results thereof.

TABLE 26

| Sample No. | $W15/50_L$ (W/kg) | $W15/50_{L+C}$ (W/kg) | $B50_L$ (T) | $B50_{L+C}$ (T) | Remarks |
|---|---|---|---|---|---|
| 161 | 4.2 | 4.4 | 1.82 | 1.80 | Inventive Example |
| 162 | 3.9 | 4.1 | 1.83 | 1.81 | Inventive Example |
| 163 | 3.8 | 4.1 | 1.83 | 1.81 | Inventive Example |
| 164 | 3.7 | 3.9 | 1.84 | 1.83 | Inventive Example |

As shown in Table 26, in Sample Nos. 161 to 164, the chemical composition was within the range of the invention, and the parameter R in the thickness middle portion was within the range of the invention. Accordingly, good magnetic characteristics were obtained. In Sample Nos. 162, and 163 in which the sheet traveling tension was 3 MPa or less, the elastic strain anisotropy was low, and particularly excellent results were obtained in the iron loss $W15/50_L$, average value $W15/50_{L+C}$, magnetic flux density $B50_L$, and average value $B50_{L+C}$. In Sample No. 164 in which the cooling rate from 920° C. to 700° C. was 1° C./sec or less, the elastic strain anisotropy was further reduced, and more excellent results were obtained in the iron loss $W15/50_L$, average value $W15/50_{L+C}$, magnetic flux density $B50_L$, and average value $B50_{L+C}$. In the measurement of the elastic strain anisotropy, a sample having a quadrangular planar shape in which each side had a length of 55 mm, two sides were parallel to the rolling direction, and two sides were parallel to the direction perpendicular to the rolling direction (sheet width direction) was cut out from each non-oriented electrical steel sheet, and the length of each side after deformation under the influence of elastic strain was measured. Then, it was determined how much the length in the direction perpendicular to the rolling direction was greater than the length in the rolling direction.

INDUSTRIAL APPLICABILITY

The invention can be used in, for example, manufacturing industries for non-oriented electrical steel sheets and industries using non-oriented electrical steel sheets.

What is claimed is:

1. A non-oriented electrical steel sheet comprising, as a chemical composition, by mass %:

C: 0.0030% or less;

Si: 2.00% or less;

Al: 1.00% or less;

Mn: 0.10% to 2.00%;

S: 0.0030% or less;

one or more selected from the group consisting of Mg, Ca, Sr, Ba, Nd, Pr, La, Ce, Zn, and Cd: 0.0015% to 0.0100% in total;

a parameter Q represented by Formula 1 where [Si] denotes a Si content in mass %, [Al] denotes an Al content in mass %, and [Mn] denotes a Mn content in mass %: 2.00 or less;

Sn: 0.00% to 0.40%;

Cu: 0.00% to 1.00%; and a remainder: Fe and impurities, wherein a parameter R represented by Formula 2 where $I_{100}$, $I_{310}$, $I_{411}$, $I_{521}$, $I_{111}$, $I_{211}$, $I_{332}$, and $I_{221}$ denote a {100} crystal orientation intensity, a {310} crystal orientation intensity, a {411} crystal orientation intensity, a {521} crystal orientation intensity, a {111} crystal orientation intensity, a {211} crystal orientation intensity, a {332} crystal orientation intensity, and a {221} crystal orientation intensity in a thickness middle portion, respectively, is 0.80 or greater, $$Q=[Si]+2\times[Al]-[Mn] \quad \text{(Formula 1)}$$

$$R=(I_{100}+I_{310}+I_{411}+I_{521})/(I_{111}+I_{211}+I_{332}+I_{221}) \quad \text{(Formula 2).}$$

2. The non-oriented electrical steel sheet according to claim 1, wherein in the chemical composition, by mass %, either Sn: 0.02% to 0.40% or Cu: 0.10% to 1.00%, or both are satisfied.

3. A method for manufacturing the non-oriented electrical steel sheet according to claim 1, comprising:

continuous casting a molten steel;

hot rolling a steel ingot obtained by the continuous casting;

cold rolling a steel strip obtained by the hot rolling; and final annealing a cold rolled steel sheet obtained by the cold rolling, wherein the molten steel has the chemical composition according to claim 1, the steel strip has a columnar grain ratio of 80% or greater by area fraction and an average grain size of 0.10 mm or greater, and a rolling reduction in the cold rolling is 90% or less.

4. The method for manufacturing the non-oriented electrical steel sheet according to claim 3, wherein in the continuous casting, a temperature difference between one surface and the other surface of the steel ingot during solidification is 40° C. or higher.

5. The method for manufacturing the non-oriented electrical steel sheet according to claim 3, wherein in the hot rolling, a hot rolling start temperature is 900° C. or lower, and a coiling temperature for the steel strip is 650° C. or lower.

6. The method for manufacturing the non-oriented electrical steel sheet according to claim 4, wherein in the hot rolling, a hot rolling start temperature is 900° C. or lower, and a coiling temperature for the steel strip is 650° C. or lower.

7. The method for manufacturing the non-oriented electrical steel sheet according to claim 3, wherein in the final annealing, a sheet traveling tension is 3 MPa or less, and a cooling rate from 950° C. to 700° C. is 1° C./sec or less.

8. The method for manufacturing the non-oriented electrical steel sheet according to claim 4, wherein in the final annealing, a sheet traveling tension is 3 MPa or less, and a cooling rate from 950° C. to 700° C. is 1° C./sec or less.

9. The method for manufacturing the non-oriented electrical steel sheet according to claim 5, wherein in the final annealing, a sheet traveling tension is 3 MPa or less, and a cooling rate from 950° C. to 700° C. is 1° C./sec or less.

10. The method for manufacturing the non-oriented electrical steel sheet according to claim 7, wherein in the final annealing, a sheet traveling tension is 3 MPa or less, and a cooling rate from 950° C. to 700° C. is 1° C./sec or less.

11. A method for manufacturing the non-oriented electrical steel sheet according to claim 2, comprising:

continuous casting a molten steel;

hot rolling a steel ingot obtained by the continuous casting;

cold rolling a steel strip obtained by the hot rolling; and final annealing a cold rolled steel sheet obtained by the cold rolling, wherein the molten steel has the chemical composition according to claim 2, the steel strip has a columnar grain ratio of 80% or greater by area fraction and an average grain size of 0.10 mm or greater, and a rolling reduction in the cold rolling is 90% or less.

12. A method for manufacturing the non-oriented electrical steel sheet according to claim 1, comprising:

rapid solidifying a molten steel;

cold rolling a steel strip obtained by the rapid solidifying; and final annealing a cold rolled steel sheet obtained by the cold rolling, wherein:

the molten steel has the chemical composition according to claim 1, in the rapid solidifying, the molten steel is solidified by using a moving cooling wall, a temperature of the molten steel to be injected to the moving cooling wall is adjusted to be at least 25° C. higher than a solidification temperature of the molten steel, and an average cooling rate from completion of the solidification of the molten steel to coiling of the steel strip is 1,000 to 3,000° C./min, the steel strip has a columnar grain ratio of 80% or greater by area fraction and an average grain size of 0.10 mm or greater, and a rolling reduction in the cold rolling is 90% or less.

13. The method for manufacturing the non-oriented electrical steel sheet according to claim 12, wherein a sheet traveling tension in the final annealing is 3 MPa or less, and a cooling rate from 950° C. to 700° C. is 1° C./sec or less.

14. A method for manufacturing the non-oriented electrical steel sheet according to claim 2, comprising:

rapid solidifying a molten steel;

cold rolling a steel strip obtained by the rapid solidifying; and final annealing a cold rolled steel sheet obtained by the cold rolling, wherein:

the molten steel has the chemical composition according to claim 2, in the rapid solidifying, the molten steel is solidified by using a moving cooling wall, a temperature of the molten steel to be injected to the moving cooling wall is adjusted to be at least 25° C. higher than a solidification temperature of the molten steel, and an average cooling rate from completion of the solidification of the molten steel to coiling of the steel strip is 1,000 to 3,000° C./min, the steel strip has a columnar grain ratio of 80% or greater by area fraction and an average grain size of 0.10 mm or greater, and a rolling reduction in the cold rolling is 90% or less.

* * * * *